US008069040B2

(12) United States Patent
Vos

(10) Patent No.: US 8,069,040 B2
(45) Date of Patent: Nov. 29, 2011

(54) SYSTEMS, METHODS, AND APPARATUS FOR QUANTIZATION OF SPECTRAL ENVELOPE REPRESENTATION

(75) Inventor: Koen Bernard Vos, San Francisco, CA (US)

(73) Assignee: QUALCOMM Incorporated, San Diego, CA (US)

( * ) Notice: Subject to any disclaimer, the term of this patent is extended or adjusted under 35 U.S.C. 154(b) by 990 days.

(21) Appl. No.: 11/397,872

(22) Filed: Apr. 3, 2006

(65) Prior Publication Data

US 2006/0271356 A1 Nov. 30, 2006

Related U.S. Application Data

(60) Provisional application No. 60/667,901, filed on Apr. 1, 2005, provisional application No. 60/673,965, filed on Apr. 22, 2005.

(51) Int. Cl.
*G10L 19/12* (2006.01)
*G10L 19/00* (2006.01)

(52) U.S. Cl. ..... 704/222; 704/223; 704/230

(58) Field of Classification Search ..... 704/222–223, 704/230

See application file for complete search history.

(56) References Cited

U.S. PATENT DOCUMENTS 3,158,693 A 11/1964 Flanagan et al.
3,855,414 A 12/1974 Alleva et al.
3,855,416 A 12/1974 Fuller
4,616,659 A 10/1986 Prezas et al.
4,630,305 A 12/1986 Borth et al.
4,696,041 A 9/1987 Sakata
4,747,143 A 5/1988 Kroeger et al.
4,805,193 A 2/1989 McLaughlin et al.
4,852,179 A 7/1989 Fette
4,862,168 A * 8/1989 Beard ..... 341/140
5,077,798 A * 12/1991 Ichikawa et al. ..... 704/222
5,086,475 A * 2/1992 Kutaragi et al. ..... 704/265
5,119,424 A * 6/1992 Asakawa et al. ..... 704/208
5,285,520 A * 2/1994 Matsumoto et al. ..... 704/200
5,455,888 A * 10/1995 Iyengar et al. ..... 704/208
5,581,652 A 12/1996 Abe et al.
5,684,920 A * 11/1997 Iwakami et al. ..... 704/203
5,689,615 A 11/1997 Benyassine et al.
5,694,426 A 12/1997 McCree
5,699,477 A 12/1997 McCree
5,699,485 A 12/1997 Shoham
5,704,003 A 12/1997 Kleijn et al.
5,706,395 A 1/1998 Arslan (Continued)

FOREIGN PATENT DOCUMENTS

CA 2429832 6/2002

(Continued)

OTHER PUBLICATIONS

International Search Report, PCT/US2006/012227, International Search Authority—European—Jul. 17, 2006.

(Continued)

*Primary Examiner* — Eric Yen
(74) *Attorney, Agent, or Firm* — Heejong Yoo

(57) ABSTRACT

A quantizer according to an embodiment is configured to quantize a smoothed value of an input value (e.g., a vector of line spectral frequencies) to produce a corresponding output value, where the smoothed value is based on a scale factor and a quantization error of a previous output value.

51 Claims, 11 Drawing Sheets

U.S. PATENT DOCUMENTS 5,727,085 A * 3/1998 Toyama et al. ..... 382/232
5,737,716 A 4/1998 Bergstrom et al.
5,757,938 A * 5/1998 Akagiri et al. ..... 381/98
5,774,842 A * 6/1998 Nishio et al. ..... 704/226
5,797,118 A * 8/1998 Saito ..... 704/222
5,890,126 A 3/1999 Lindemann
5,966,689 A 10/1999 McCree
5,978,759 A 11/1999 Tsushima et al.
6,009,395 A 12/1999 Lai et al.
6,014,619 A 1/2000 Wuppermann et al.
6,029,125 A 2/2000 Hagen et al.
6,041,297 A * 3/2000 Goldberg ..... 704/219
6,097,824 A 8/2000 Lindemann et al.
6,134,520 A * 10/2000 Ravishankar ..... 704/222
6,144,936 A 11/2000 Jarvinen et al.
6,223,151 B1 4/2001 Kleijn et al.
6,263,307 B1 7/2001 Arslan
6,301,556 B1 10/2001 Hagen et al.
6,330,534 B1 * 12/2001 Yasunaga et al. ..... 704/223
6,330,535 B1 * 12/2001 Yasunaga et al. ..... 704/223
6,353,808 B1 3/2002 Matsumoto et al.
6,385,261 B1 5/2002 Tsuji et al.
6,449,590 B1 9/2002 Gao
6,523,003 B1 2/2003 Chandran et al.
6,564,187 B1 5/2003 Kikumoto et al.
6,675,144 B1 * 1/2004 Tucker et al. ..... 704/264
6,678,654 B2 1/2004 Zinser, Jr. et al.
6,680,972 B1 1/2004 Liljeryd et al.
6,681,204 B2 1/2004 Matsumoto
6,704,702 B2 3/2004 Oshiriki et al.
6,704,711 B2 3/2004 Gustafsson et al.
6,711,538 B1 3/2004 Omori et al.
6,715,125 B1 * 3/2004 Juang ..... 714/814
6,732,070 B1 5/2004 Rotola-Pukkila et al.
6,735,567 B2 5/2004 Gao et al.
6,751,587 B2 * 6/2004 Thyssen et al. ..... 704/228
6,757,395 B1 6/2004 Fang et al.
6,757,654 B1 * 6/2004 Westerlund et al. ..... 704/262
6,772,114 B1 * 8/2004 Sluijter et al. ..... 704/220
6,826,526 B1 * 11/2004 Norimatsu et al. ..... 704/222
6,879,955 B2 4/2005 Rao
6,889,185 B1 5/2005 McCree
6,895,375 B2 5/2005 Malah et al.
6,925,116 B2 8/2005 Liljeryd et al.
6,988,066 B2 1/2006 Malah
7,003,451 B2 2/2006 Kjorling et al.
7,016,831 B2 * 3/2006 Suzuki et al. ..... 704/203
7,024,354 B2 4/2006 Ozawa
7,031,912 B2 * 4/2006 Yajima et al. ..... 704/208
7,050,972 B2 5/2006 Henn et al.
7,069,212 B2 6/2006 Tanaka et al.
7,088,779 B2 * 8/2006 Aarts ..... 375/245
7,136,810 B2 11/2006 Paksoy et al.
7,149,683 B2 12/2006 Jelinek
7,155,384 B2 * 12/2006 Banba ..... 704/212
7,167,828 B2 1/2007 Ehara
7,174,135 B2 2/2007 Sluijter et al.
7,191,123 B1 3/2007 Bessette et al.
7,191,125 B2 3/2007 Huang
7,222,069 B2 * 5/2007 Suzuki et al. ..... 704/201
7,228,272 B2 6/2007 Rao
7,242,763 B2 7/2007 Etter
7,260,523 B2 8/2007 Paksoy et al.
7,330,814 B2 2/2008 McCree
7,346,499 B2 * 3/2008 Chennoukh et al. ..... 704/205
7,359,854 B2 * 4/2008 Nilsson et al. ..... 704/219
7,376,554 B2 * 5/2008 Ojala et al. ..... 704/207
7,392,179 B2 * 6/2008 Yasunaga et al. ..... 704/222
7,428,490 B2 9/2008 Xu et al.
7,596,492 B2 9/2009 Sung et al.
7,613,603 B2 * 11/2009 Yamashita ..... 704/200.1
2001/0044722 A1 11/2001 Gustafsson et al.
2002/0007280 A1 1/2002 McCree
2002/0052738 A1 5/2002 Paksoy et al.
2002/0072899 A1 6/2002 Paksoy et al.
2002/0087308 A1 7/2002 Ozawa
2002/0103637 A1 8/2002 Henn et al.
2002/0173951 A1 11/2002 Ehara
2003/0009327 A1 1/2003 Nilsson et al.
2003/0036905 A1 2/2003 Toguri et al.
2003/0093278 A1 5/2003 Malah
2003/0093279 A1 5/2003 Malah et al.
2003/0200092 A1 10/2003 Gao
2004/0019492 A1 1/2004 Tucker et al.
2004/0098255 A1 5/2004 Kovesi et al.
2004/0101038 A1 5/2004 Etter
2004/0128126 A1 7/2004 Nam et al.
2004/0153313 A1 8/2004 Aubauer et al.
2004/0181398 A1 9/2004 Sung
2004/0204935 A1 10/2004 Anandakumar et al.
2005/0004793 A1 1/2005 Ojala et al.
2005/0065782 A1 3/2005 Stachurski
2005/0071153 A1 3/2005 Tammi et al.
2005/0071156 A1 3/2005 Xu et al.
2005/0143980 A1 6/2005 Huang
2005/0143985 A1 6/2005 Sung et al.
2005/0143989 A1 6/2005 Jelinek
2005/0149339 A1 7/2005 Tanaka et al.
2005/0251387 A1 11/2005 Jelinek et al.
2005/0261897 A1 11/2005 Jelinek
2006/0206334 A1 9/2006 Kapoor et al.
2006/0271356 A1 11/2006 Vos
2006/0277038 A1 12/2006 Vos et al.
2006/0277039 A1 12/2006 Vos et al.
2006/0277042 A1 12/2006 Vos et al.
2006/0282262 A1 12/2006 Vos et al.
2006/0282263 A1 12/2006 Vos et al.
2007/0088541 A1 4/2007 Vos et al.
2007/0088542 A1 4/2007 Vos et al.
2007/0088558 A1 4/2007 Vos et al.
2008/0126086 A1 5/2008 Vos et al.

FOREIGN PATENT DOCUMENTS

EP 0732687 9/1996
EP 1008984 6/2000
EP 1089258 4/2001
EP 1126620 8/2001
EP 1164579 12/2001
EP 1300833 4/2003
EP 1498873 1/2005
JP 2244100 A 9/1990
JP 08180582 7/1996
JP 8248997 A 9/1996
JP 8305396 A 11/1996
JP 9101798 A 4/1997
JP 2000206989 A 7/2000
JP 2001100773 A 4/2001
JP 2001237708 A 8/2001
JP 2001337700 A 12/2001
JP 2002268698 9/2002
JP 2003243990 A 8/2003
JP 2003526123 T 9/2003
JP 2004126011 A 4/2004
JP 2005345707 A 12/2005
KR 1020010023579 3/2001
RU 2073913 2/1997
RU 2131169 5/1999
RU 2233010 7/2004
TW 525147 3/2003
TW 526468 4/2003
WO 9848541 10/1998
WO 0156021 8/2001
WO WO2002052738 7/2002
WO 02086867 10/2002
WO 03021993 3/2003
WO 03044777 5/2003

OTHER PUBLICATIONS

International Preliminary Report—PCT/US2006/012227, International Search Authority—The International Bureau of WIPO, Geneva, Switzerland—Oct. 3, 2007.

Written Opinion—PCT/US2006/012227, International Search Authority, European Patent Office—Jul. 17, 2006.

Bessette, et al., "The Adaptive Multirate Wideband Speech Codec (AMR-WB)," IEEE Tr. on Speech and Audio Processing, vol. 10, No. 8, Nov. 2002, pp. 620-636.

McCree, A., "A 14 kb/s Wideband Speech Coder With a Parametric Highband Model," Int. Conf. on Acoustic Speech and Signal Processing, Turkey, 2000, pp. 1153-1156.
Digital Radio Mondiale (DRM); System Specification; ETSI ES 201 980. ETSI Standards, European Telecommunications Standards Institute, Sophia-Antipo, FR, vol. BC, No. V122, Apr. 2003, XP 014004528. ISSN: 0000-0001, pp. 1-188.
Doser, A., et al., Time Frequency Techniques for Signal Feature Detection. IEEE, XP010374021, Oct. 24, 1999, pp. 452-456, vol. 1. Thirty-Third Asilomar Conference.
Drygajilo, A. Speech Coding Techniques and Standards. Last accessed Dec. 15, 2006 at http://scgwww.epfl.ch/courses/Traitement_de_la_parole-2004-2005-pdf/12-codage%20Ppur-Drygajlo-Chapter-4-3.pdf. 23 pp. (chapter of Speech and Language Engineering.
Hagen, R et al. ,"Removal of Sparse-excitation artifacts in CELP," Proc. ICASSP, May 1998. vol. 1, pp. 145-148, xp010279147.
Kleijn, W. Bastiaan, et al., "The RCELP Speech-Coding Algorithm," European Transactions on Telecommunications and Related Technologies, Sep.-Oct. 1994, pp. 39-48, vol. 5, No. 5, Milano, IT XP000470678.
Makhoul, J. and Berouti, M.. "High Frequency Regeneration in Speech Coding Systems," Proc. IEEE Int. Conf. on Acoustic Speech and Signal Processing, Washington, 1979, pp. 428-431.
Massimo Gregorio Muzzi, Amelioration d'un codeur parametrique. Rapport Du Stage, XP002388943, Jul. 2003, pp. 1-76.
McCree, Alan, et al., An Embedded Adaptive Multi-Rate Wideband Speech Coder, IEEE International Conference on Acoustics, Speech, and Signal Processing, May 7-11, 2001, pp. 761-764, vol. 1 of 6.
Nilsson et al., "Gaussian Mixture Model based Mutual Information Estimation between Frequency Based in Speech," Proc. IEEE Int. Conf. on Acoustic Speech and Signal Processing, Florida, 2002, pp. 525-528.
Nomura, T., et al.,"A bitrate and bandwidth scalable CELP coder," Acoustics, Speech and Signal Processing, May 1998. vol. 1, pp. 341-344, XP010279059.
P.P. Vaidyanathan, Multirate Digital Filters, Filter Banks, Polyphase Networks, and Applications: A Tutorial, Proceedings of the IEEE, XP 000125845. Jan. 1990, pp. 56-93, vol. 78, No. 1.
Tammi, Mikko, et al., "Coding Distortion Caused by a Phase Difference Between the LP Filter and its Residual," IEEE, 1999, pp. 102-104, XP10345571A.
The CCITT G. 722 Wideband Speech Coding Standard 3 pp. Last Accessed Dec. 15, 2006 at http://www.umiacs.Umd.edu/users/desin/Speech/mode3.html.
TS 26.090 v2.0.0, Mandatory Speech Codec speech processing functions. Jun. 1999. Cover, section 6, pp. 37-41, and figure 4, p. 49. p. 7.
Valin, J.-M., Lefebvre, R., "Bandwidth Extension of Narrowband Speech for Low Bit-Rate Wideband Coding." Proc. IEEE Speech Coding Workshop (SCW), 2000, pp. 130-132.
Wideband Speech Coding Standards and Applications. VoiceAge Whitepaper. 17 pp. Last accessed Dec. 15, 2006 at http://www.voiceage.com/media/WidebandSpeech.pdf.
Epps, J. "Wideband Extension of Narrowband Speech for Enhancement and Coding." Ph.D. thesis, Univ. of New South Wales, Sep. 2000. Cover, chs. 4-6 (pp. 66-121), and ch. 7 (pp. 122-129).
Jelinek, M. et al.: "Noise reduction method for wideband speech coding," Euro. Sig. Proc. Conf., Vienna, Austria, Sep. 2004, pp. 1959-1962.
Makinen, J et al.: "The Effect of Source Based Rate Adaptation Extension in AMR-WB Speech Codec" Speech Coding, 2002, IEE Workshop Proceedings. Oct. 6-9, 2002, Piscataway, NJ, USA, IEEE, pp. 153-155.
Nilsson M et al.: "Avoiding Over-Estimation in Bandwidth Extension of Telephony Speech" 2001 IEEE International Confeence on Acoustics, Speech, and Signal Processing. Proceedings (ICASSP). Salt Lake City, UT, May 7-11, 2001, IEEE International Conference on Acoustics, Speech, and Signal Processing. pp. 869-872.
Qian, Y et al.: Classified Highband Excitation for Bandwidth Extension of Telephony Signals. Proc. Euro. Sig. proc. Conf. Anatalya, Turkey, Sep. 2005. 4 pages.
Universal Mobile Telecommunications System (UMTS); audio codec processing functions; Extended Adaptive MultiR-Rate-Wideband (AMR-WB+) code; Transcoding functions (3GPP TS 26.290 version 6.2.0 release 6); ETSI TS 126 290, ETSI Standards, European Telecommunication Standards Institute, vol. 3-SA4, No. v620, Mar. 2005, pp. 1-86.
Budagavi, M. et al. Speech Coding in Mobile Radio Communications. Proc. IEEE, vol. 86, No. 7, Jul. 1998, pp. 1402-1412.
Chu, W. et al. Optimization of window and LSF interpolation factor for the ITU-T G.729 speech coding standard. 4 pp. (Eurospeech 2003, Geneva, pp. 1061-1064.).
Guibe, G. et al. Speech Spectral Quantizers for Wideband Speech Coding. 11 pp. Last accessed Dec. 14, 2006 at http://eprints.ecs.soton.ac.uk/6376/01/1178_pap.pdf (Euro. Trans. on Telecom., 12(6), pp. 535-545, 2001).
Guleryuz, O. et al. On the DPCM Compression of Gaussian Auto-Regressive Sequences. 33 pp. Last accessed Dec. 14, 2006 at http://eeweb.poly.edu/~onur/publish/dpcm.pdf.
Harma, A. et al. A comparison of warped and conventional linear predictive coding. 11 pp. Last accessed Dec. 15, 2006 at http://www.acoustics.hut.fi/~aqi/wwwPhD/P8.PDF. (IEEE Trans. Speech Audio Proc., vol. 9, No. 5, Jul. 2001, pp. 579-588.).
Kim, A. et al. Improving the rate-distortion performance of DPCM. Proc. 7th ISSPA, Paris, FR, Jul. 2003. 4 pp.
Koishida, K. et al. A 16-kbit/s bandwidth scalable audio coder based on the G.729 standard. Proc. ICASSP, Istanbul, Turkey, Jun. 2000, 4 pp. (vol. 2, pp. 1149-1152).
Lahouti, F. et al. Single and double frame coding of speech LPC parameters using a lattice-based quantization scheme. IEEE Trans. Audio, Speech, and Lang. Proc., 9 pp. (Preprint of vol. 14, No. 5, Sep. 2006, pp. 1624-1632.).
Lahouti, F. et al. Single and Double Frame Coding of Speech LPC Parameters Using a Lattice-based Quantization Scheme. Tech. Rpt. UW-E&CE#2004-10, Univ. of Waterloo, ON, Apr. 2004. 22 pp.
McCree, A. et al. A 1.7 kb/s MELP coder with improved analysis and quantization. 4 pp. (Proc. ICASSP, Seattle, WA, May 1998, pp. 593-596.).
Noise shaping (Wikipedia entry). 3 pp. Last accessed Dec. 15, 2006 at http://en.wikipedia.org/wiki/Noise_shaping.
Norden, F. et al. A speech spectrum distortion measure with interframe memory. 4 pp. (Proc. ICASSP, Salt Lake City, UT, May 2001, vol. 2.).
Pereira, W. et al. Improved spectral tracking using interpolated linear prediction parameters. Proc. ICASSP, Orlando, FL, May 2002, pp. I-261-I-264.
Ramachandran, R. et al. Pitch Prediction Filters in Speech Coding. IEEE Trans. Acoustics, Speech, and Sig. Proc., vol. 37, No. 4, Apr. 1989, pp. 467-478.
Roy, G. Low-rate analysis-by-synthesis wideband speech coding. MS thesis, McGill Univ., Montreal, QC, Aug. 1990. Cover, ch. 3 (pp. 19-38), and ch. 6 (pp. 87-91).
Samuelsson, J. et al. Controlling Spectral Dynamics in LPC Quantization for Perceptual Enhancement. 5 pp. (Proc. 31st Asilomar Conf. Sig. Syst. Comp., 1997, pp. 1066-1070.).
D17 So, S. Efficient Block Quantisation for Image and Speech Coding. Ph.D. thesis, Griffith Univ., Brisbane, AU, Mar. 2005. Cover and chs. 5 and 6 (pp. 195-293).
3rd Generation Partnership Project 2 ("3GPP2"), Enhanced Variable Rate Codec, Speech Service Options 3, 68, and 70 for Wideband Spread Spectrum Digital Systems, 3GPP2 C.S0014-C, ver. 1.0, Jan. 2007.
European Telecommunications Standards Institute (ETSI) 3rd Generation Partnership Project (3GPP), Digital cellular telecommunications system (Phase 2+), Full rate speech, Transcoding, GSM 06.10, ver. 8.1.1, Release 1999.
European Telecommunications Standards Institute (ETSI) 3rd Generation Partnership Project (3GPP), Digital cellular telecommunications system (Phase 2+), Enhanced Full Rate (EFR) speech transcoding, GSM 06.60, ver. 8.0.1, Release 1999.
International Telecommunications Union, Telecommunication Standardization Sector of ITU ("ITU-T"), Series G: Transmission Systems and Media, Digital Systems and Networks, Digital transmission systems—Terminal equipments—Coding of analogue signals by methods other than PCM, Coding of speech at 8 kbit/s using Conjugate-Structure Algebraic-Code-Excited Linear-Prediction (CS-ACELP), Annex E: 11.8 kbit/s CS-ACELP speech coding algorithm ("G.729 Annex E"), Sep. 1998.
Postel, Jon, ed., Internet protocol, Request for Comments (Standard) RFC 791, Internet Engineering Task Force, Sep. 1981. (Obsoletes RFC 760), URL:http://www.ietf.org/rfc/rfc791.txt.
Knagenhjelm, Petter H.; Kleijn, Bastiaan W., Spectral dynamics is more important than spectral distortion, 1995 International Conference on Acoustics, Speech, and Signal Processing (ICASSP-95), vol. 1, pp. 732-735, May 9-12, 1995.
Dattoro, J., et al: "Error spectrum shaping and vector quantization" Oct. 1997, CP002307027, Retrieved online, Stanford University; URL: www.stanford.edu/~dattoro/proj392c.pdf.
Anonymous: "Noise shaping" Dec. 5, 2004, XP002387163 Wikipedia.org, Retrieved online, Wikipedia.org, URL: http://en.wikipedia.org/w/index.php?title=Noise_shaping&oldid=8138470.
Hsi-Wen Nein et al: "Incorporating error shaping technique into LSF vector quantization" IEEE Transactions on Speech and Audio Processing, IEEE Service Center, New York, NY, US, vol. 9, No. 2, Feb. 2001, XP011054076:1063-6676.
Cabral, "Evaluation of Method for Excitation Regeneration in Bandwidth Extension of Speech", Master thesis, KTH, sweden, Mar. 27, 2003.
Hsu, "Robust bandwidth extension of narrowband speech", McGill University, Canada, Nov. 2004.
Normura et al., "A bitrate and bandwidth scalable CELP coder." Proceedings of the 1998 IEEE ICASSP, vol. 1, pp. 341-344, May 12, 1998.
Vaseghi, "Advanced Digital Signal Processing and Noise Reduction", Ch 13, Published by John Wiley and Sons Ltd., 2000.
Kim, Jusub. "Filter Bank Design and Subband Coding," (Project 1 Report), University of Maryland, Retrieved Online: <http://www.ece.umd.edu/class/enee624.S2003/ENEE624jusub.pdf>, pp. 1-26, published Mar. 31, 2003.
"Signal Processing Toolbox: For Use with MATLAB User's Guide," ver. 4.2, Published by The Math Works Inc., Jan. 1999.

* cited by examiner

SYSTEMS, METHODS, AND APPARATUS FOR QUANTIZATION OF SPECTRAL ENVELOPE REPRESENTATION

RELATED APPLICATIONS

This application claims benefit of U.S. Provisional Pat. Appl. No. 60/667,901, entitled "CODING THE HIGH-FREQUENCY BAND OF WIDEBAND SPEECH," filed Apr. 1, 2005. This application also claims benefit of U.S. Provisional Pat. Appl. No. 60/673,965, entitled "PARAMETER CODING IN A HIGH-BAND SPEECH CODER," filed Apr. 22, 2005.

This application is also related to the following U.S. patent applications filed herewith: "SYSTEMS, METHODS, AND APPARATUS FOR WIDEBAND SPEECH CODING," Ser. No. 11/397,794; "SYSTEMS, METHODS, AND APPARATUS FOR HIGHBAND EXCITATION GENERATION," Ser. No. 11/397,870; "SYSTEMS, METHODS, AND APPARATUS FOR ANTI-SPARSENESS FILTERING," Ser. No. 11/397,505; "SYSTEMS, METHODS, AND APPARATUS FOR GAIN CODING," Ser. No. 11/397,871; "SYSTEMS, METHODS, AND APPARATUS FOR HIGHBAND BURST SUPPRESSION," Ser. No. 11/397,433; "SYSTEMS, METHODS, AND APPARATUS FOR HIGHBAND TIME WARPING," Ser. No. 11/397,370; and "SYSTEMS, METHODS, AND APPARATUS FOR SPEECH SIGNAL FILTERING," Ser. No. 11/397,432.

FIELD OF THE INVENTION

This invention relates to signal processing.

BACKGROUND

A speech encoder sends a characterization of the spectral envelope of a speech signal to a decoder in the form of a vector of line spectral frequencies (LSFs) or a similar representation. For efficient transmission, these LSFs are quantized.

SUMMARY

A quantizer according to one embodiment is configured to quantize a smoothed value of an input value (such as a vector of line spectral frequencies or portion thereof) to produce a corresponding output value, where the smoothed value is based on a scale factor and a quantization error of a previous output value.

DETAILED DESCRIPTION

Due to quantization error, the spectral envelope reconstructed in the decoder may exhibit excessive fluctuations. These fluctuations may produce an objectionable "warbly" quality in the decoded signal. Embodiments include systems, methods, and apparatus configured to perform high-quality wideband speech coding using temporal noise shaping quantization of spectral envelope parameters. Features include fixed or adaptive smoothing of coefficient representations such as highband LSFs. Particular applications described herein include a wideband speech coder that combines a narrowband signal with a highband signal.

Unless expressly limited by its context, the term "calculating" is used herein to indicate any of its ordinary meanings, such as computing, generating, and selecting from a list of values. Where the term "comprising" is used in the present description and claims, it does not exclude other elements or operations. The term "A is based on B" is used to indicate any of its ordinary meanings, including the cases (i) "A is equal to B" and (ii) "A is based on at least B." The term "Internet Protocol" includes version 4, as described in IETF (Internet Engineering Task Force) RFC (Request for Comments) 791, and subsequent versions such as version 6.

Figure 7A:
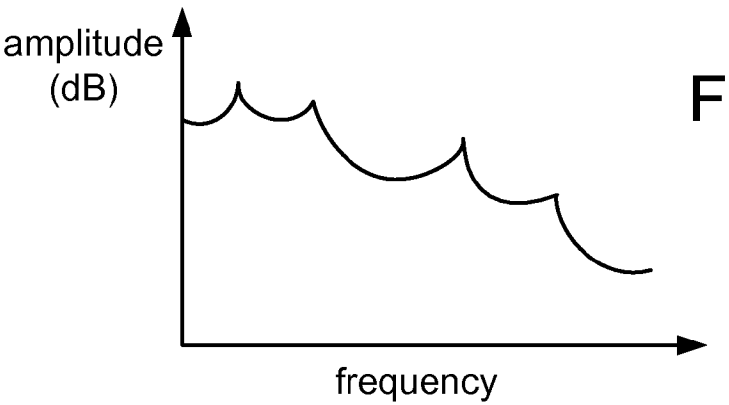
FIG. 7*a* shows an example of a plot of log amplitude vs. frequency for a speech signal.

A speech encoder may be implemented according to a source-filter model that encodes the input speech signal as a set of parameters that describe a filter. For example, a spectral envelope of a speech signal is characterized by a number of peaks that represent resonances of the vocal tract and are called formants. FIG. 7*a* shows one example of such a spectral envelope. Most speech coders encode at least this coarse spectral structure as a set of parameters such as filter coefficients.

Figure 1A:
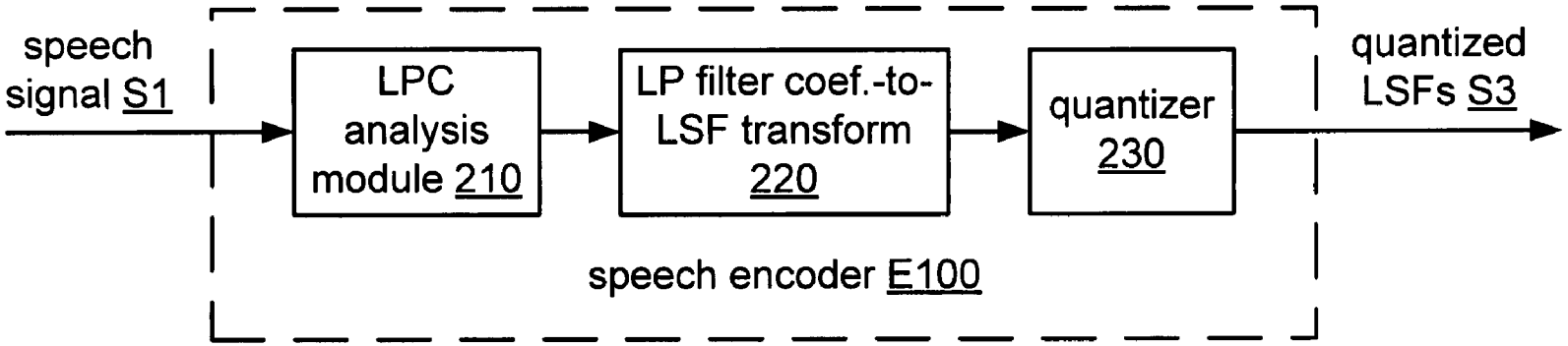
FIG. 1*a* shows a block diagram of a speech encoder E100 according to an embodiment.

FIG. 1*a* shows a block diagram of a speech encoder E100 according to an embodiment. As shown in this example, the analysis module may be implemented as a linear prediction coding (LPC) analysis module 210 that encodes the spectral envelope of the speech signal Si as a set of linear prediction (LP) coefficients (e.g., coefficients of an all-pole filter 1/A (z)). The analysis module typically processes the input signal as a series of nonoverlapping frames, with a new set of coefficients being calculated for each frame. The frame period is generally a period over which the signal may be expected to be locally stationary; one common example is 20 milliseconds (equivalent to 160 samples at a sampling rate of 8 kHz). One example of a lowband LPC analysis module (as shown, e.g., in FIG. 8 as LPC analysis module 210) is configured to calculate a set of ten LP filter coefficients to characterize the formant structure of each 20-millisecond frame of narrowband signal S20, and one example of a highband LPC analysis module (as shown, e.g. in FIG. 10*a* as highband encoder A200) is configured to calculate a set of six (alternatively, eight) LP filter coefficients to characterize the formant structure of each 20-millisecond frame of highband signal S30. It is also possible to implement the analysis module to process the input signal as a series of overlapping frames.

The analysis module may be configured to analyze the samples of each frame directly, or the samples may be weighted first according to a windowing function (for example, a Hamming window). The analysis may also be performed over a window that is larger than the frame, such as a 30-msec window. This window may be symmetric (e.g. 5-20-5, such that it includes the 5 milliseconds immediately before and after the 20-millisecond frame) or asymmetric (e.g. 10-20, such that it includes the last 10 milliseconds of the preceding frame). An LPC analysis module is typically configured to calculate the LP filter coefficients using a Levinson-Durbin recursion or the Leroux-Gueguen algorithm. In another implementation, the analysis module may be configured to calculate a set of cepstral coefficients for each frame instead of a set of LP filter coefficients.

The output bit rate of a speech encoder may be reduced significantly, with relatively little effect on reproduction quality, by quantizing the filter parameters. Linear prediction filter coefficients are difficult to quantize efficiently and are usually mapped by the speech encoder into another representation, such as line spectral pairs (LSPs) or line spectral frequencies (LSFs), for quantization and/or entropy encoding. Speech encoder E100 as shown in FIG. 1*a* includes a LP filter coefficient-to-LSF transform 220 configured to transform the set of LP filter coefficients into a corresponding vector of LSFs S3. Other one-to-one representations of LP filter coefficients include parcor coefficients; log-area-ratio values; immittance spectral pairs (ISPs); and immittance spectral frequencies (ISFs), which are used in the GSM (Global System for Mobile Communications) AMR-WB (Adaptive Multirate-Wideband) codec. Typically a transform between a set of LP filter coefficients and a corresponding set of LSFs is reversible, but embodiments also include implementations of a speech encoder in which the transform is not reversible without error.

A speech encoder typically includes a quantizer configured to quantize the set of narrowband LSFs (or other coefficient representation) and to output the result of this quantization as the filter parameters. Quantization is typically performed using a vector quantizer that encodes the input vector as an index to a corresponding vector entry in a table or codebook. Such a quantizer may also be configured to perform classified vector quantization. For example, such a quantizer may be configured to select one of a set of codebooks based on information that has already been coded within the same frame (e.g., in the lowband channel and/or in the highband channel). Such a technique typically provides increased coding efficiency at the expense of additional codebook storage.

Figure 1B:
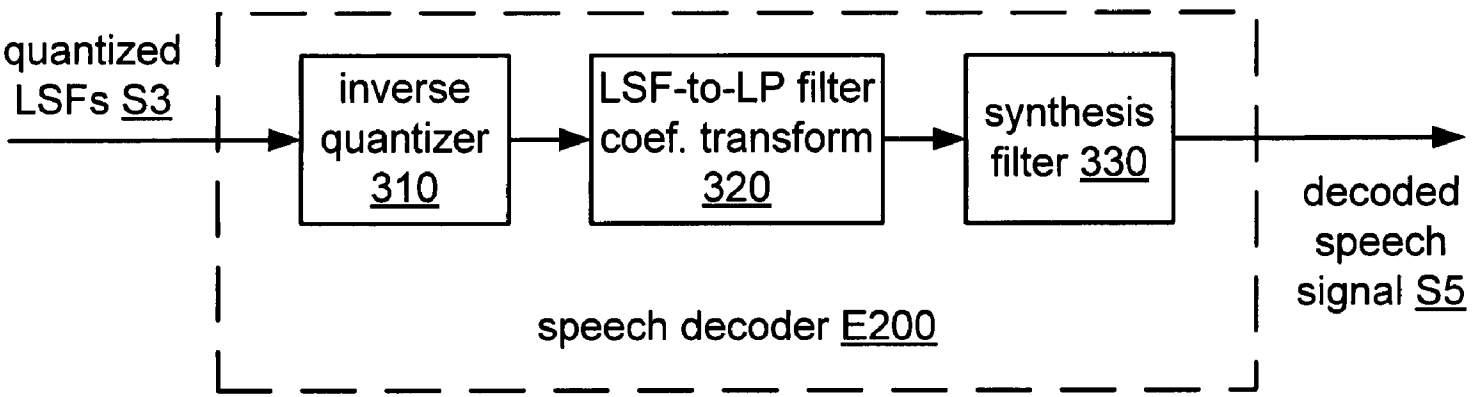
FIG. 1*b* shows a block diagram of a speech decoder E200.

FIG. 1*b* shows a block diagram of a corresponding speech decoder E200 that includes an inverse quantizer 310 configured to dequantize the quantized LSFs S3, and a LSF-to-LP filter coefficient transform 320 configured to transform the dequantized LSF vector into a set of LP filter coefficients. A synthesis filter 330, configured according to the LP filter coefficients, is typically driven by an excitation signal to produce a synthesized reproduction, i.e. a decoded speech signal S5, of the input speech signal. The excitation signal may be based on a random noise signal and/or on a quantized representation of the residual as sent by the encoder. In some multiband coders such as wideband speech encoder A100 and decoder B100 (as described herein with reference to, e.g., FIGS. 10*a,b* and 11*a,b*), the excitation signal for one band is derived from the excitation signal for another band.

Quantization of the LSFs introduces a random error that is usually uncorrelated from one frame to the next. This error may cause the quantized LSFs to be less smooth than the unquantized LSFs and may reduce the perceptual quality of the decoded signal. Independent quantization of LSF vectors generally increases the amount of spectral fluctuation from frame to frame compared to the unquantized LSF vectors, and these spectral fluctuations may cause the decoded signal to sound unnatural.

One complicated solution was proposed by Knagenhjelm and Kleijn, "Spectral Dynamics is More Important than Spectral Distortion," 1995 International Conference on Acoustics, Speech, and Signal Processing (ICASSP-95), vol. 1, pp. 732-735, 9-12 May 1995, in which a smoothing of the dequantized LSF parameters is performed in the decoder. This reduces the spectral fluctuations, but comes at the cost of additional delay. The present application describes methods that use temporal noise shaping on the encoder side, such that spectral fluctuations may be reduced without additional delay.

Figure 2:
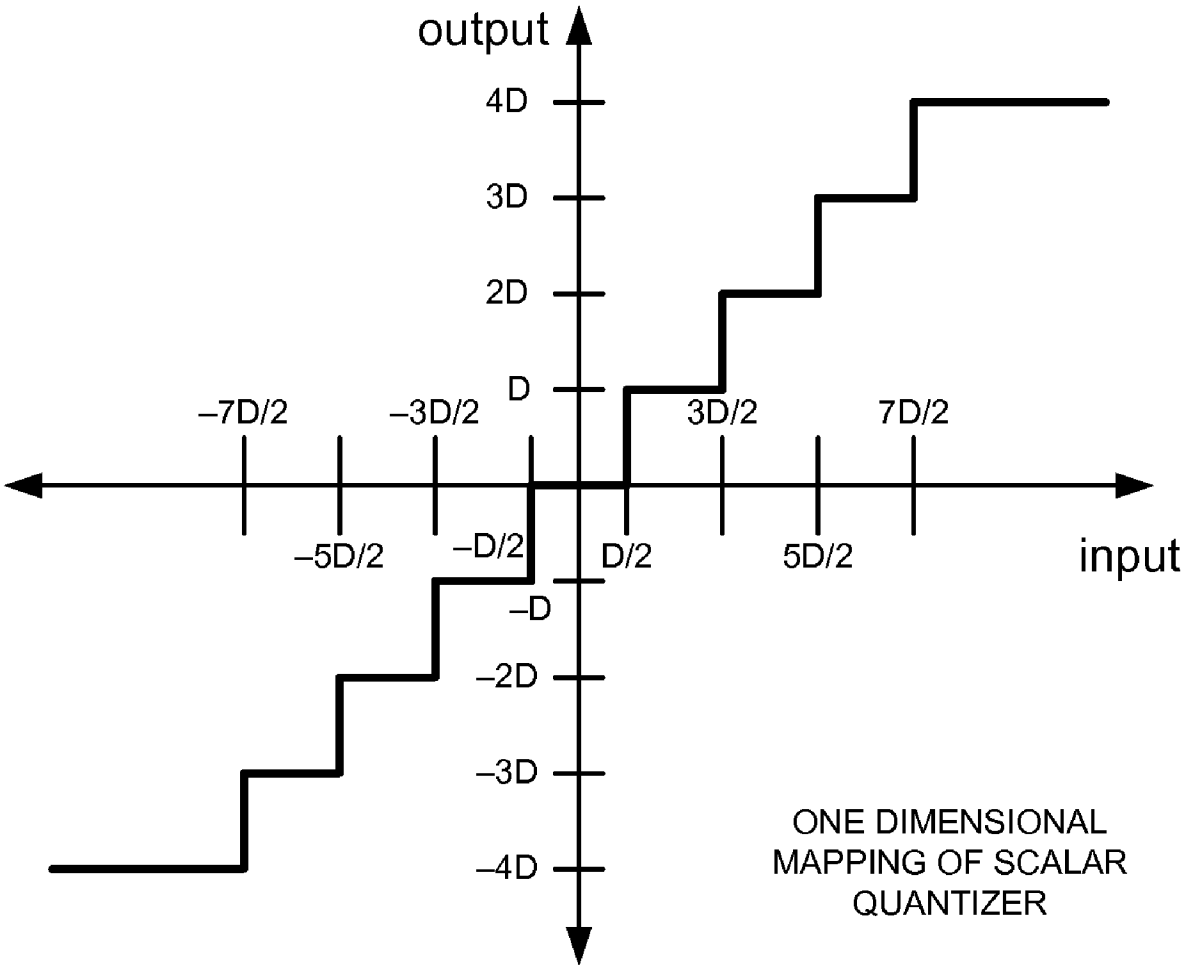
FIG. 2 shows an example of a one-dimensional mapping typically performed by a scalar quantizer.

A quantizer is typically configured to map an input value to one of a set of discrete output values. A limited number of output values are available, such that a range of input values is mapped to a single output value. Quantization increases coding efficiency because an index that indicates the corresponding output value may be transmitted in fewer bits than the original input value. FIG. 2 shows an example of a one-dimensional mapping typically performed by a scalar quantizer.

Figure 3:
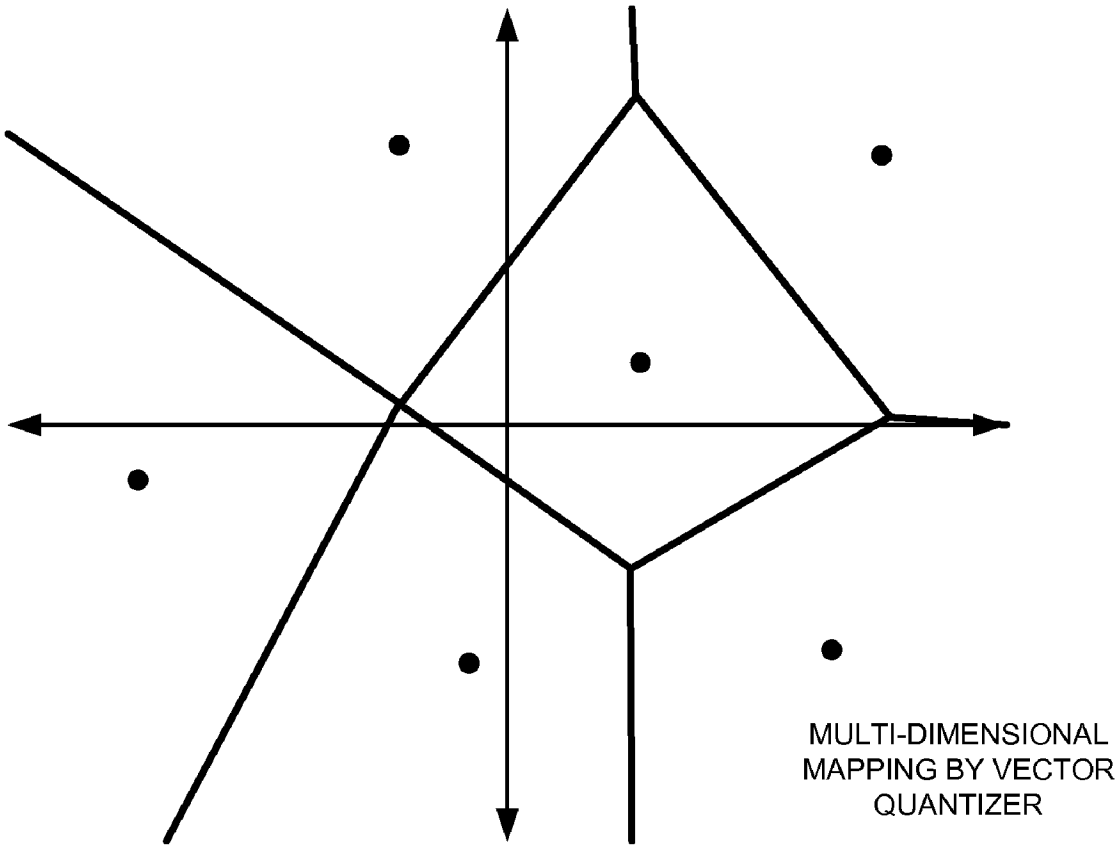
FIG. 3 shows one simple example of a multi-dimensional mapping as performed by a vector quantizer.

The quantizer could equally well be a vector quantizer, and LSFs are typically quantized using a vector quantizer. FIG. 3 shows one simple example of a multi-dimensional mapping as performed by a vector quantizer. In this example, the input space is divided into a number of Voronoi regions (e.g., according to a nearest-neighbor criterion). The quantization maps each input value to a value that represents the corresponding Voronoi region (typically, the centroid), shown here as a point. In this example, the input space is divided into six regions, such that any input value may be represented by an index having only six different states.

Figure 4A:
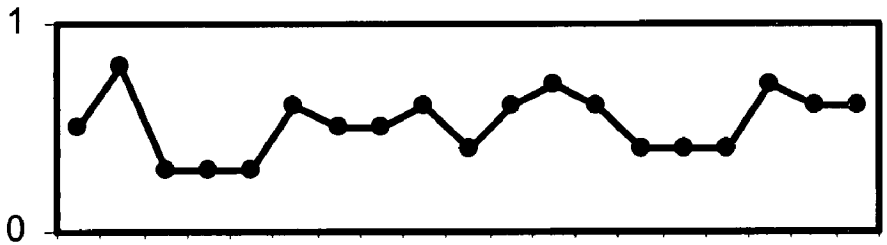
FIG. 4*a* shows one example of a one-dimensional signal.
Figure 4B:
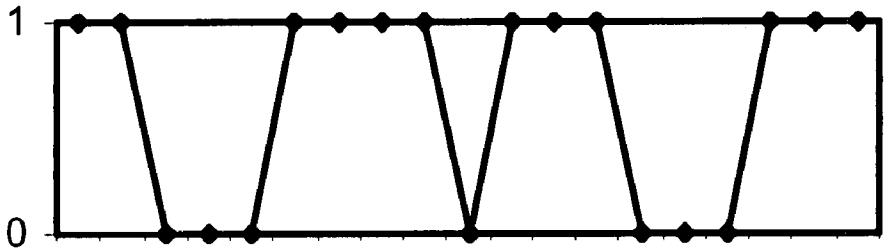
FIG. 4*b* shows an example of a version of this signal after quantization.

If the input signal is very smooth, it can happen sometimes that the quantized output is much less smooth, according to a minimum step between values in the output space of the quantization. FIG. 4*a* shows one example of a smooth one-dimensional signal that varies only within one quantization level (only one such level is shown here), and FIG. 4*b* shows an example of this signal after quantization. Even though the input in FIG. 4*a* varies over only a small range, the resulting output in FIG. 4*b* contains more abrupt transitions and is much less smooth. Such an effect may lead to audible artifacts, and it may be desirable to reduce this effect for LSFs (or other representations of the spectral envelope to be quantized). For example, LSF quantization performance may be improved by incorporating temporal noise shaping.

In a method according to one embodiment, a vector of spectral envelope parameters is estimated once for every frame (or other block) of speech in the encoder. The parameter vector is quantized for efficient transmission to the decoder. After quantization, the quantization error (defined as the difference between quantized and unquantized parameter vector) is stored. The quantization error of frame N−1 is reduced by a scale factor and added to the parameter vector of frame N, before quantizing the parameter vector of frame N. It may be desirable for the value of the scale factor to be smaller when the difference between current and previous estimated spectral envelopes is relatively large.

In a method according to one embodiment, the LSF quantization error vector is computed for each frame and multiplied by a scale factor b having a value less than 1.0. Before quantization, the scaled quantization error for the previous frame is added to the LSF vector (input value V 10). A quantization operation of such a method may be described by an expression such as the following:

$$y(n)=Q[s(n)],s(n)=x(n)+b[y(n-1)-s(n-1)],$$

where x(n) is the input LSF vector pertaining to frame n, s(n) is the smoothed LSF vector pertaining to frame n, y(n) is the quantized LSF vector pertaining to frame n, Q(·) is a nearest-neighbor quantization operation, and b is the scale factor.

Figure 5:
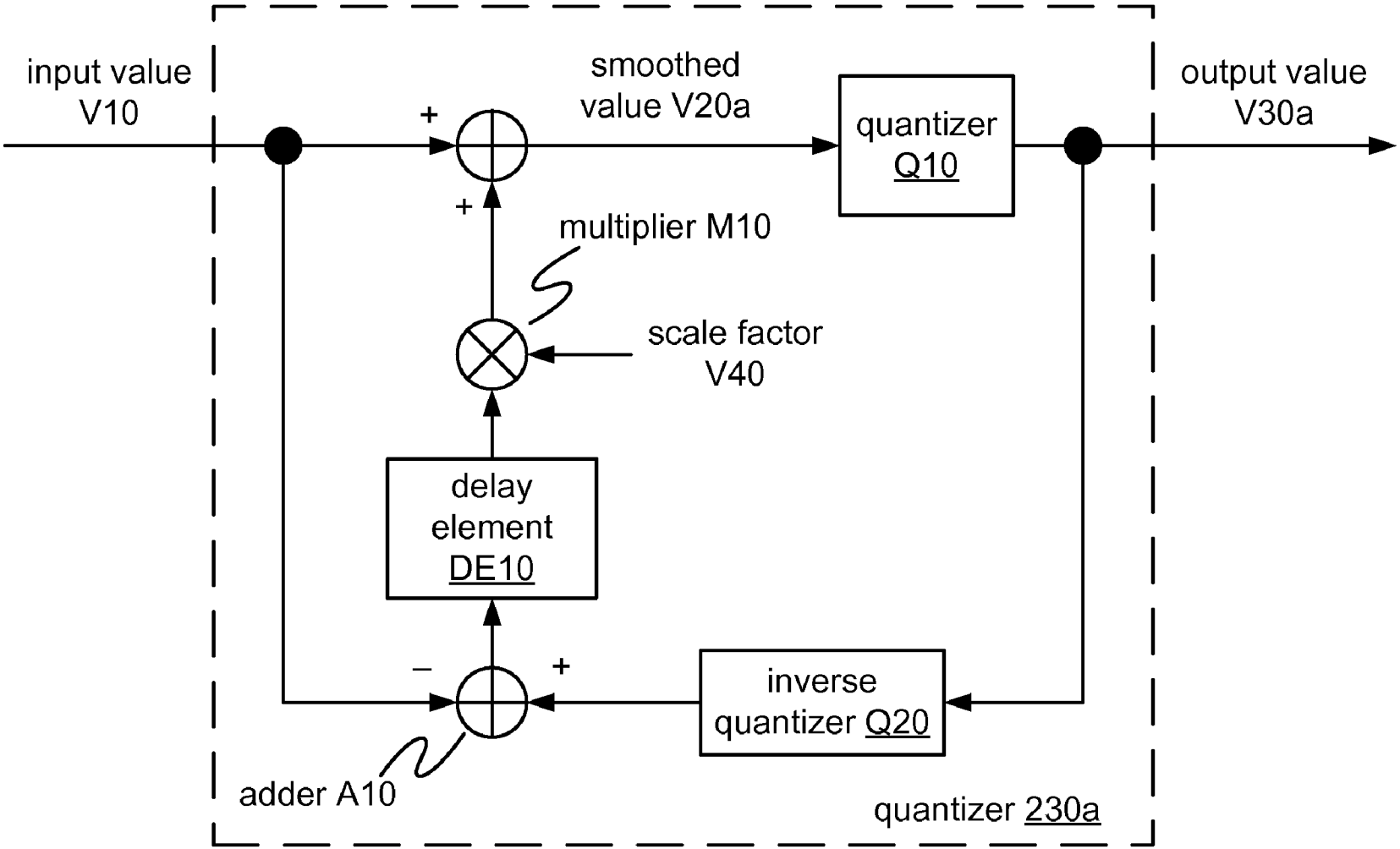
FIG. 5 shows a block diagram of an implementation 230*a* of a quantizer 230 according to an embodiment.

A quantizer 230 according to an embodiment is configured to produce a quantized output value V30 of a smoothed value V20 of an input value V10 (e.g., an LSF vector), where the smoothed value V20 is based on a scale factor V40 and a quantization error of a previous output value V30. Such a quantizer may be applied to reduce spectral fluctuations without additional delay. FIG. 5 shows a block diagram of one implementation 230*a* of quantizer 230, in which values that may be particular to this implementation are indicated by the index a. In this example, a quantization error is computed by using adder A10 to subtract the current input value V10 from the current output value V30*a* as dequantized by inverse quantizer Q20. The error is stored to a delay element DE10. Smoothed value V20*a* is a sum of the current input value V10 and the quantization error of the previous frame as scaled (e.g. multiplied in multiplier M10) by scale factor V40. Quantizer 230*a* may also be implemented such that the scale factor V40 is applied before storage of the quantization error to delay element DE10 instead.

Figure 4C:
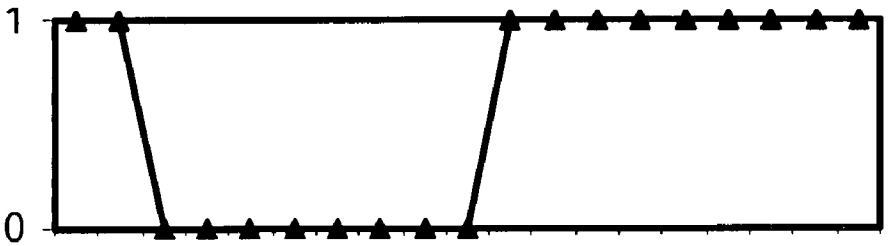
FIG. 4*c* shows an example of the signal of FIG. 4*a* as quantized by a quantizer 230*b* as shown in FIG. 6.
Figure 4D:
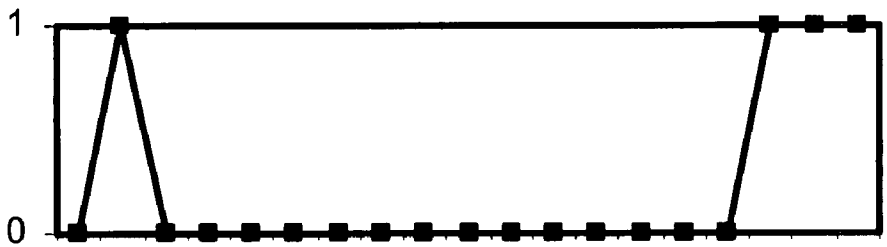
FIG. 4*d* shows an example of the signal of FIG. 4*a* as quantized by a quantizer 230*a* as shown in FIG. 5.

FIG. 4*d* shows an example of a (dequantized) sequence of output values V30*a* as produced by quantizer 230*a* in response to the input signal of FIG. 4*a*. In this example, the value of scale factor V40 is fixed at 0.5. It may be seen that the signal of FIG. 4*d* is smoother than the fluctuating signal of FIG. 4*a*.

It may be desirable to use a recursive function to calculate the feedback amount. For example, the quantization error may be calculated with respect to the current input value rather than with respect to the current smoothed value. Such a method may be described by an expression such as the following:

$$y(n)=Q[s(n)],s(n)=x(n)+b[y(n-1)-s(n-1)],$$

where x(n) is the input LSF vector pertaining to frame n.

Figure 6:
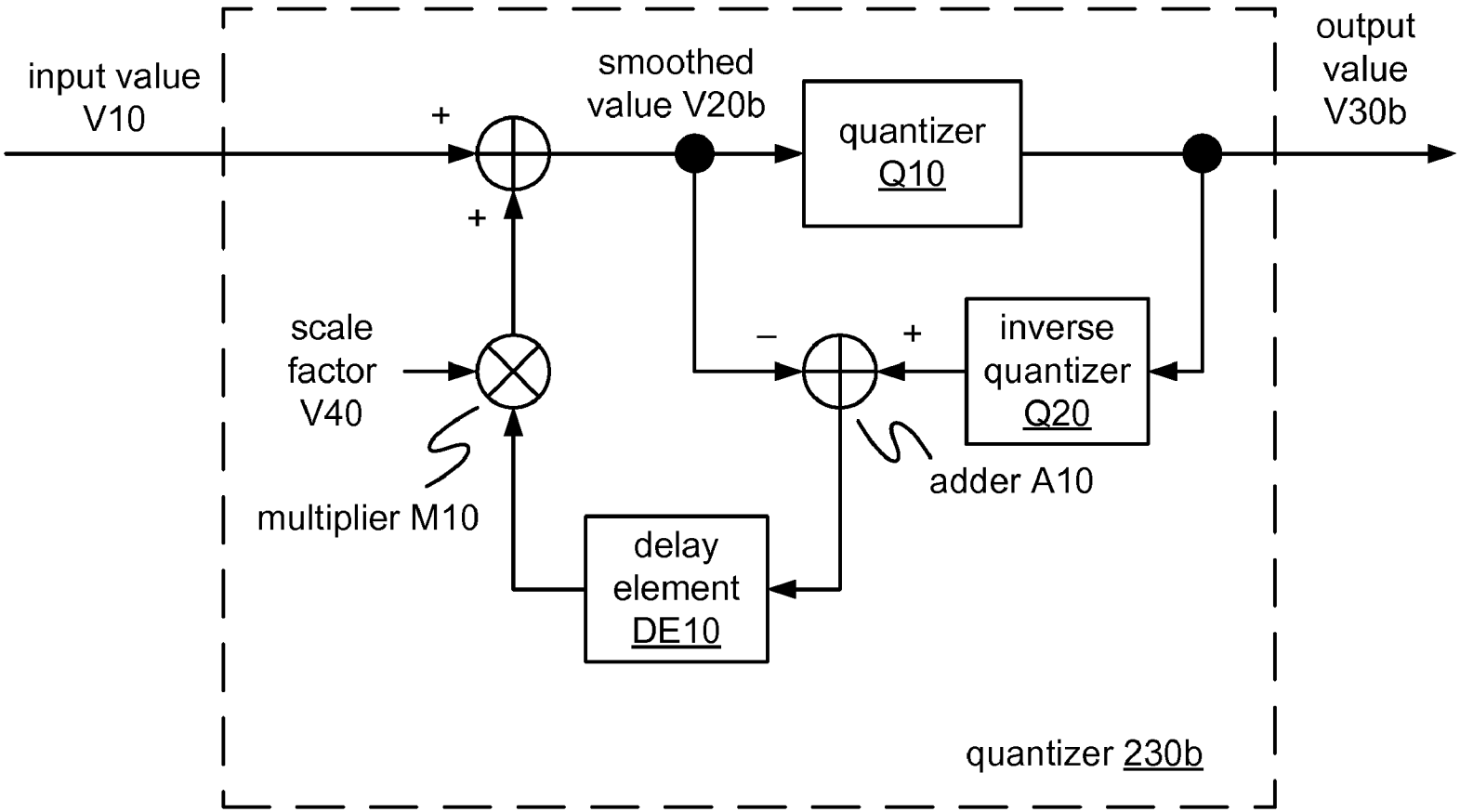
FIG. 6 shows a block diagram of an implementation 230*b* of a quantizer 230 according to an embodiment.

FIG. 6 shows a block diagram of an implementation 230*b* of quantizer 230, in which values that may be particular to this implementation are indicated by the index b. In this example, a quantization error is computed by using adder A10 to subtract the current value of smoothed value V20*b* from the current output value V30*b* as dequantized by inverse quantizer Q20. The error is stored to delay element DE10. Smoothed value V20*b* is a sum of the current input value V10 and the quantization error of the previous frame as scaled (e.g. multiplied in multiplier M10) by scale factor V40. Quantizer 230*b* may also be implemented such that the scale factor V40 is applied before storage of the quantization error to delay element DE10 instead. It is also possible to use different values of scale factor V40 in implementation 230*a* as opposed to implementation 230*b*.

FIG. 4*c* shows an example of a (dequantized) sequence of output values V30*b* as produced by quantizer 230*b* in response to the input signal of FIG. 4*a*. In this example, the value of scale factor V40 is fixed at 0.5. It may be seen that the signal of FIG. 4*c* is smoother than the fluctuating signal of FIG. 4*a*.

It is noted that embodiments as shown herein may be implemented by replacing or augmenting an existing quantizer Q10 according to an arrangement as shown in FIG. 5 or 6. For example, quantizer Q10 may be implemented as a predictive vector quantizer, a multi-stage quantizer, a split vector quantizer, or according to any other scheme for LSF quantization.

In one example, the value of the scale factor is fixed at a desired value between 0 and 1. Alternatively, it may be desired to adjust the value of the scale factor dynamically. For example, it may be desired to adjust the value of the scale factor depending on a degree of fluctuation already present in the unquantized LSF vectors. When the difference between the current and previous LSF vectors is large, the scale factor is close to zero and almost no noise shaping results. When the current LSF vector differs little from the previous one, the scale factor is close to 1.0. In such manner, transitions in the spectral envelope over time may be retained, minimizing spectral distortion when the speech signal is changing, while spectral fluctuations may be reduced when the speech signal is relatively constant from one frame to the next.

The value of the scale factor may be made proportional to the distance between consecutive LSFs, and any of various distances between vectors may be used to determine the change between LSFs. The Euclidean norm is typically used, but others which may be used include Manhattan distance (1-norm), Chebyshev distance (infinity norm), Mahalanobis distance, Hamming distance.

It may be desired to use a weighted distance measure to determine a change between consecutive LSF vectors. For example, the distance d may be calculated according to an expression such as the following:

$$d=\sum_{i=1}^{P} c_i(l_i-\hat{l}_i)^2,$$

where l indicates the current LSF vector, $\hat{l}$ indicates the previous LSF vector, P indicates the number of elements in each LSF vector, the index i indicates the LSF vector element, and c indicates a vector of weighting factors. The values of c may be selected to emphasize lower frequency components that are more perceptually significant. In one example, $c_i$ has the value 1.0 for i from 1 to 8, 0.8 for i=9, and 0.4 for i=10.

In another example, the distance d between consecutive LSF vectors may be calculated according to an expression such as the following:

$$d=\sum_{i=1}^{P} c_i w_i(l_i-\hat{l}_i)^2,$$

where w indicates a vector of variable weighting factors. In one such example, $w_i$ has the value $P(f_i)^r$, where P denotes the LPC power spectrum evaluated at the corresponding frequency f, and r is a constant having a typical value of, e.g., 0.15 or 0.3. In another example, the values of w are selected according to a corresponding weight function used in the ITU-T G.729 standard:

$$w_i = \begin{cases} 1.0 & \text{if } (2\pi(l_{i+1} - l_{i-1}) - 1) > 0 \\ 10(2\pi(l_{i+1} - l_{i-1}) - 1)^2 + 1 & \text{otherwise} \end{cases},$$

with boundary values close to 0 and 0.5 being selected in place of $l_{i-1}$ and $l_{i+1}$ for the lowest and highest elements of w, respectively. In such cases, $c_i$ may have values as indicated above. In another example, $c_i$ has the value 1.0, except for $c_4$ and $c_5$ which have the value 1.2.

It may be appreciated from FIGS. 4*a-d* that on a frame-by-frame basis, a temporal noise shaping method as described herein may increase the quantization error. Although the absolute squared error of the quantization operation may increase, however, a potential advantage is that the quantization error may be moved to a different part of the spectrum. For example, the quantization error may be moved to lower frequencies, thus becoming more smooth. As the input signal is also smooth, a smoother output signal may be obtained as a sum of the input signal and the smoothed quantization error.

Figure 7B:
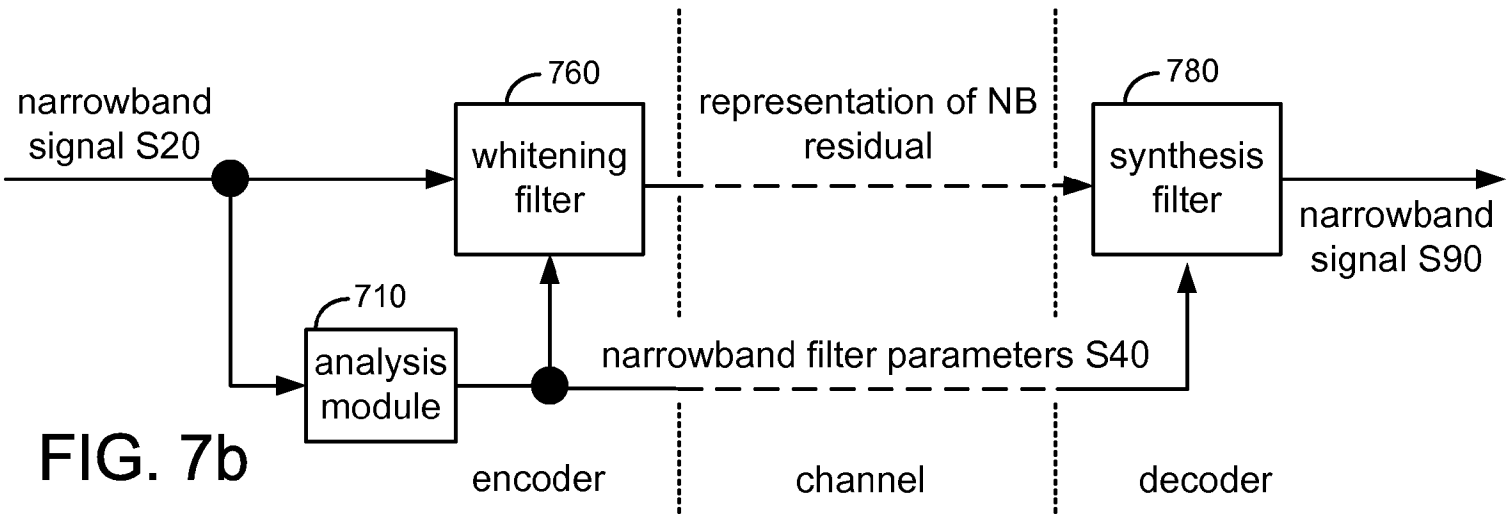
FIG. 7*b* shows a block diagram of a basic linear prediction coding system.
Figure 8:
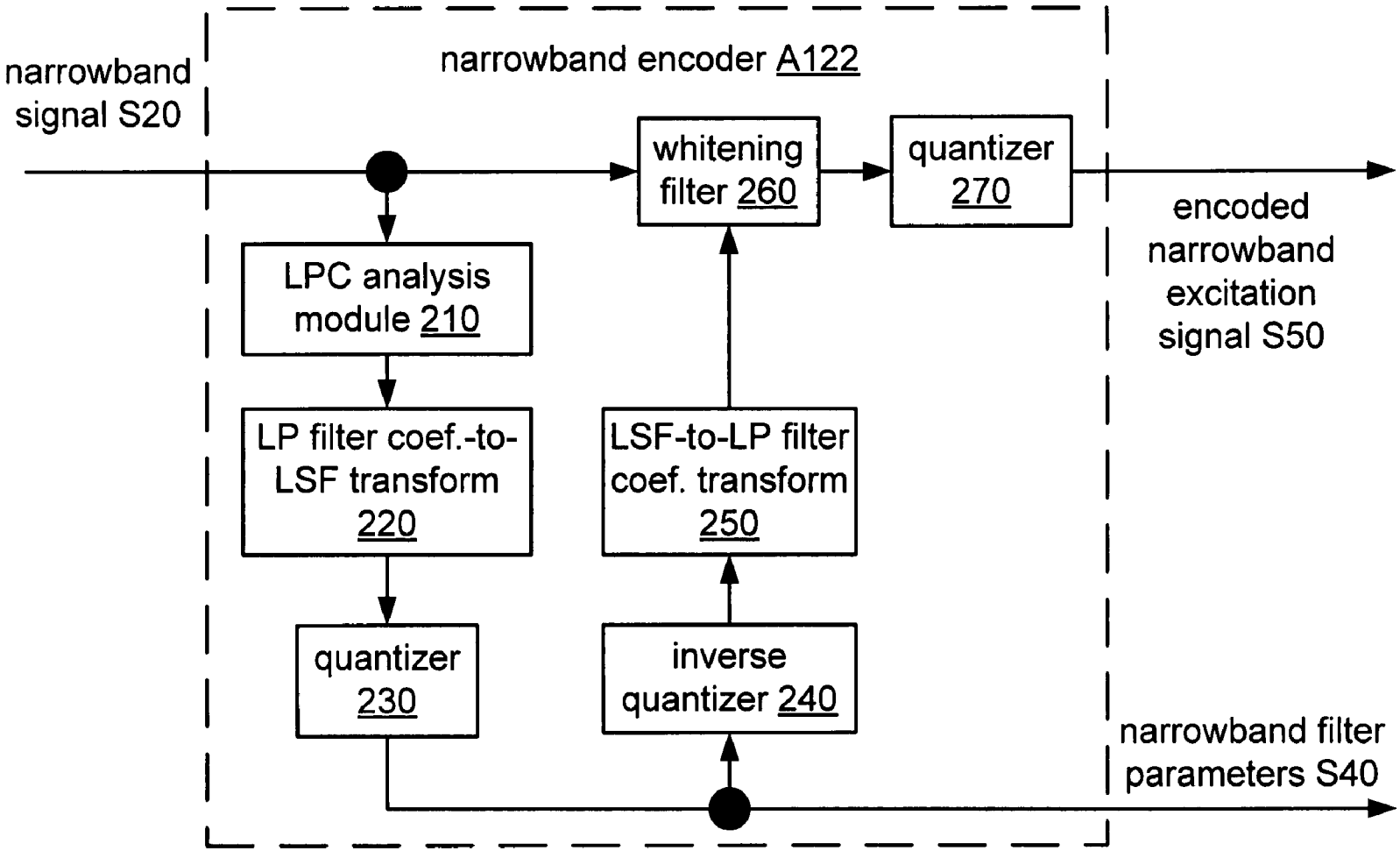
FIG. 8 shows a block diagram of an implementation A122 of a narrowband encoder A120 (as shown in FIG. 10*a*).
Figure 10A:
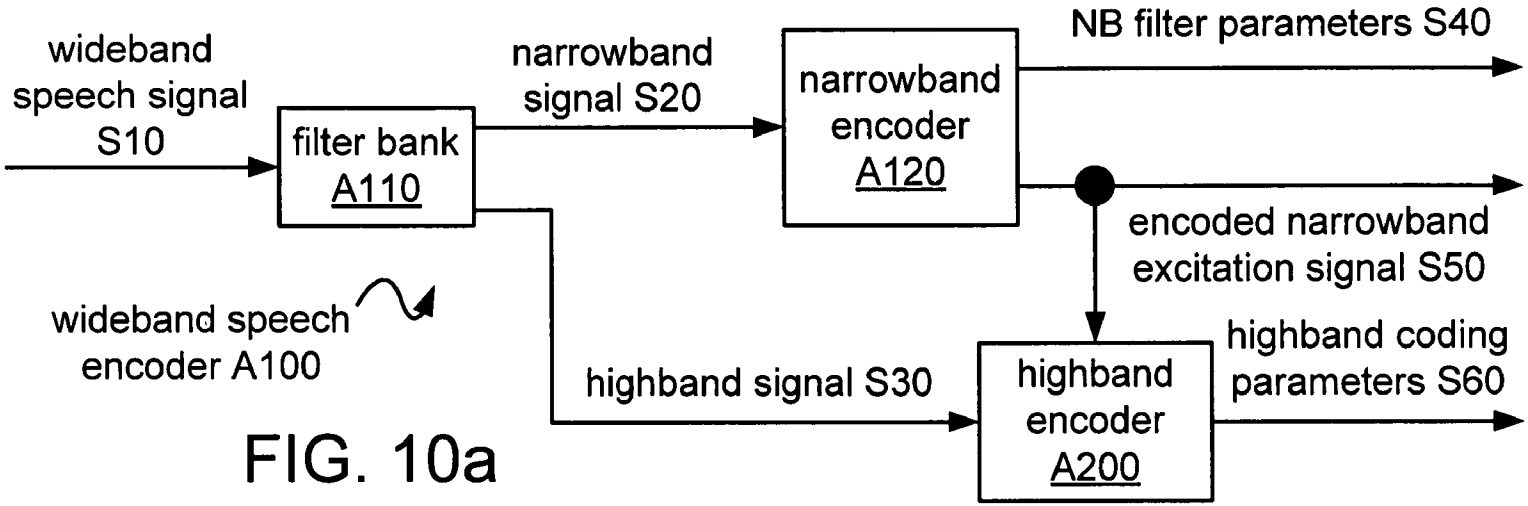
FIG. 10*a* is a block diagram of a wideband speech encoder A100.

FIG. 7*b* shows an example of a basic source-filter arrangement as applied to coding of the spectral envelope of a narrowband signal S20. An analysis module 710 calculates a set of parameters that characterize a filter corresponding to the speech sound over a period of time (typically 20 msec). A whitening filter 760 (also called an analysis or prediction error filter) configured according to those filter parameters removes the spectral envelope to spectrally flatten the signal. The resulting whitened signal (also called a residual) has less energy and thus less variance and is easier to encode than the original speech signal. Errors resulting from coding of the residual signal may also be spread more evenly over the spectrum. The filter parameters and residual are typically quantized for efficient transmission over the channel. At the decoder, a synthesis filter configured according to the filter parameters is excited by a signal based on the residual to produce a synthesized version of the original speech sound. The synthesis filter is typically configured to have a transfer function that is the inverse of the transfer function of the whitening filter. FIG. 8 shows a block diagram of a basic implementation A122 of a narrowband encoder A120 as shown in FIG. 10*a*.

As seen in FIG. 8, narrowband encoder A122 also generates a residual signal by passing narrowband signal S20 through a whitening filter 260 (also called an analysis or prediction error filter) that is configured according to the set of filter coefficients. In this particular example, whitening filter 260 is implemented as a FIR filter, although IIR implementations may also be used. This residual signal will typically contain perceptually important information of the speech frame, such as long-term structure relating to pitch, that is not represented in narrowband filter parameters S40. Quantizer 270 is configured to calculate a quantized representation of this residual signal for output as encoded narrowband excitation signal S50. Such a quantizer typically includes a vector quantizer that encodes the input vector as an index to a corresponding vector entry in a table or codebook. Alternatively, such a quantizer may be configured to send one or more parameters from which the vector may be generated dynamically at the decoder, rather than retrieved from storage, as in a sparse codebook method. Such a method is used in coding schemes such as algebraic CELP (codebook excitation linear prediction) and codecs such as the 3GPP2 (Third Generation Partnership 2) EVRC (Enhanced Variable Rate Codec).

It is desirable for narrowband encoder A120 to generate the encoded narrowband excitation signal according to the same filter parameter values that will be available to the corresponding narrowband decoder. In this manner, the resulting encoded narrowband excitation signal may already account to some extent for nonidealities in those parameter values, such as quantization error. Accordingly, it is desirable to configure the whitening filter using the same coefficient values that will be available at the decoder. In the basic example of encoder A122 as shown in FIG. 8, inverse quantizer 240 dequantizes narrowband filter parameters S40, LSF-to-LP filter coefficient transform 250 maps the resulting values back to a corresponding set of LP filter coefficients, and this set of coefficients is used to configure whitening filter 260 to generate the residual signal that is quantized by quantizer 270.

Some implementations of narrowband encoder A120 are configured to calculate encoded narrowband excitation signal S50 by identifying one among a set of codebook vectors that best matches the residual signal. It is noted, however, that narrowband encoder A120 may also be implemented to calculate a quantized representation of the residual signal without actually generating the residual signal. For example, narrowband encoder A120 may be configured to use a number of codebook vectors to generate corresponding synthesized signals (e.g., according to a current set of filter parameters), and to select the codebook vector associated with the generated signal that best matches the original narrowband signal S20 in a perceptually weighted domain.

Figure 9:
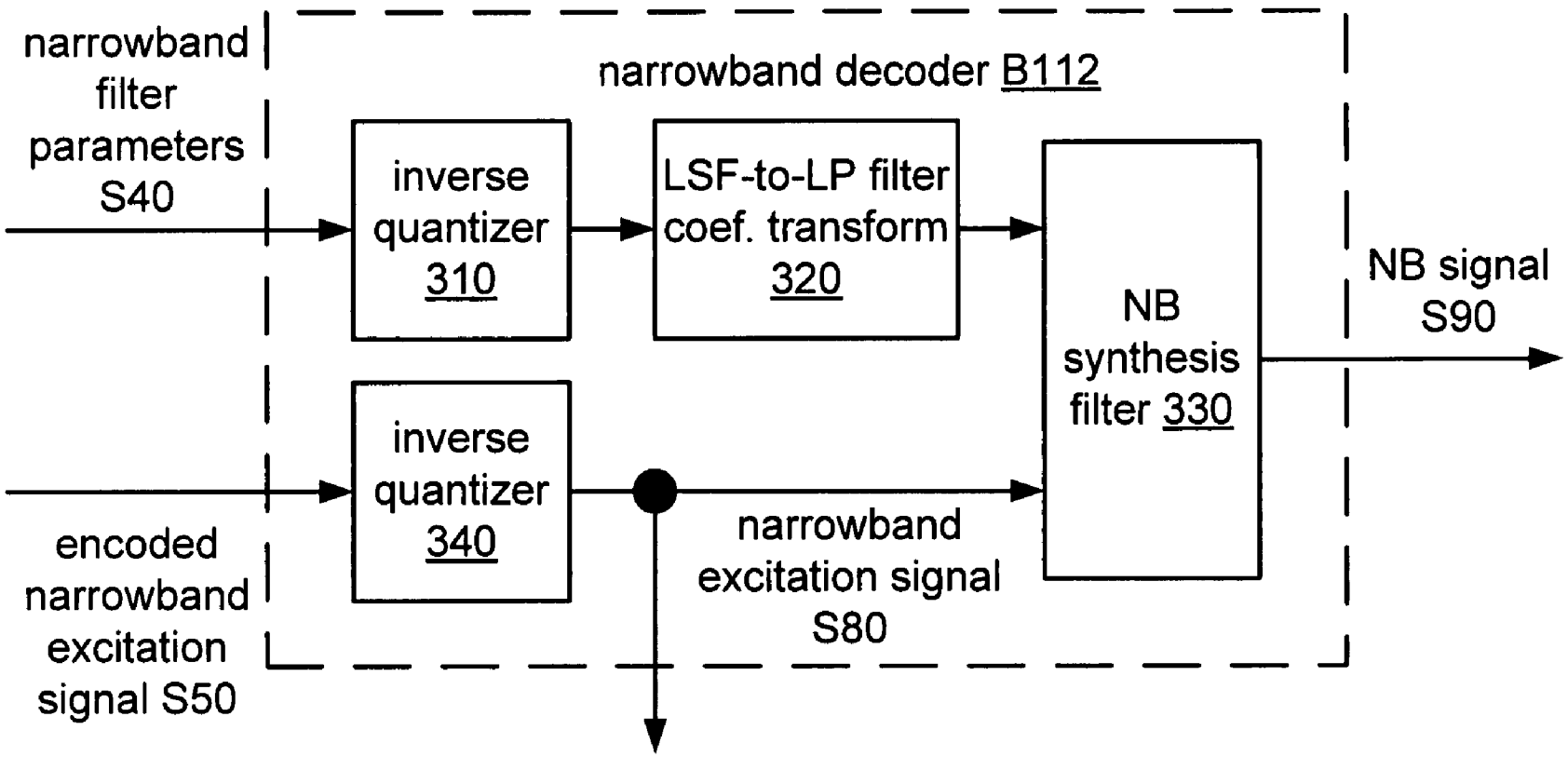
FIG. 9 shows a block diagram of an implementation B112 of a narrowband decoder B110 (as shown in FIG. 11*a*).
Figure 11A:
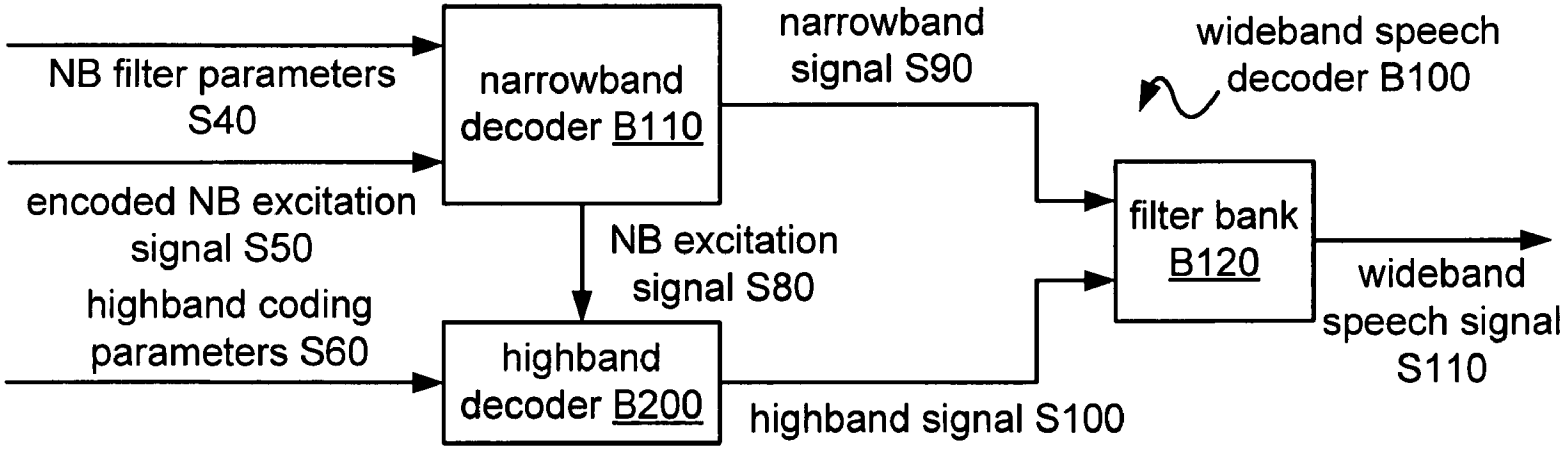
FIG. 11*a* is a block diagram of a wideband speech decoder B100 corresponding to wideband speech encoder A100.

FIG. 9 shows a block diagram of an implementation B112 of narrowband decoder B110. Inverse quantizer 310 dequantizes narrowband filter parameters S40 (in this case, to a set of LSFs), and LSF-to-LP filter coefficient transform 320 transforms the LSFs into a set of filter coefficients (for example, as described above with reference to inverse quantizer 240 and transform 250 of narrowband encoder A122). Inverse quantizer 340 dequantizes encoded narrowband excitation signal S50 to produce a narrowband excitation signal S80. Based on the filter coefficients and narrowband excitation signal S80, narrowband synthesis filter 330 synthesizes narrowband signal S90. In other words, narrowband synthesis filter 330 is configured to spectrally shape narrowband excitation signal S80 according to the dequantized filter coefficients to produce narrowband signal S90. As shown in FIG. 11*a*, narrowband decoder B112 (in the form of narrowband decoder B110) also provides narrowband excitation signal S80 to highband decoder B200, which uses it to derive a highband excitation signal. In some implementations, narrowband decoder B110 may be configured to provide additional information to highband decoder B200 that relates to the narrowband signal, such as spectral tilt, pitch gain and lag, and speech mode. The system of narrowband encoder A122 and narrowband decoder B112 is a basic example of an analysis-by-synthesis speech codec.

Voice communications over the public switched telephone network (PSTN) have traditionally been limited in bandwidth to the frequency range of 300-3400 kHz. New networks for voice communications, such as cellular telephony and voice over IP (VoIP), may not have the same bandwidth limits, and it may be desirable to transmit and receive voice communications that include a wideband frequency range over such networks. For example, it may be desirable to support an audio frequency range that extends down to 50 Hz and/or up to 7 or 8 kHz. It may also be desirable to support other applications, such as high-quality audio or audio/video conferencing, that may have audio speech content in ranges outside the traditional PSTN limits.

One approach to wideband speech coding involves scaling a narrowband speech coding technique (e.g., one configured to encode the range of 0-4 kHz) to cover the wideband spectrum. For example, a speech signal may be sampled at a higher rate to include components at high frequencies, and a narrowband coding technique may be reconfigured to use more filter coefficients to represent this wideband signal. Narrowband coding techniques such as CELP (codebook excited linear prediction) are computationally intensive, however, and a wideband CELP coder may consume too many processing cycles to be practical for many mobile and other embedded applications. Encoding the entire spectrum of a wideband signal to a desired quality using such a technique may also lead to an unacceptably large increase in bandwidth. Moreover, transcoding of such an encoded signal would be required before even its narrowband portion could be transmitted into and/or decoded by a system that only supports narrowband coding.

FIG. 10*a* shows a block diagram of a wideband speech encoder A100 that includes separate narrowband and highband speech encoders A120 and A200, respectively. Either or both of narrowband and highband speech encoders A120 and A200 may be configured to perform quantization of LSFs (or another coefficient representation) using an implementation of quantizer 230 as disclosed herein. FIG. 11*a* shows a block diagram of a corresponding wideband speech decoder B100. In FIG. 10*a*, filter bank A110 may be implemented to produce narrowband signal S20 and highband signal S30 from a wideband speech signal S10 according to the principles and implementations disclosed in the U.S. patent application "SYSTEMS, METHODS, AND APPARATUS FOR SPEECH SIGNAL FILTERING" filed herewith, now U.S. Pub. No. 2007/0088558, and this disclosure of such filter banks therein is hereby incorporated by reference. As shown in FIG. 11*a*, filter bank B120 may be similarly implemented to produce a decoded wideband speech signal S110 from a decoded narrowband signal S90 and a decoded highband signal S100. FIG. 11*a* also shows a narrowband decoder B110 configured to decode narrowband filter parameters S40 and encoded narrowband excitation signal S50 to produce a narrowband signal S90 and a narrowband excitation signal S80, and a highband decoder B200 configured to produce a highband signal S100 based on highband coding parameters S60 and narrowband excitation signal S80.

It may be desirable to implement wideband speech coding such that at least the narrowband portion of the encoded signal may be sent through a narrowband channel (such as a PSTN channel) without transcoding or other significant modification. Efficiency of the wideband coding extension may also be desirable, for example, to avoid a significant reduction in the number of users that may be serviced in applications such as wireless cellular telephony and broadcasting over wired and wireless channels.

One approach to wideband speech coding involves extrapolating the highband spectral envelope from the encoded narrowband spectral envelope. While such an approach may be implemented without any increase in bandwidth and without a need for transcoding, however, the coarse spectral envelope or formant structure of the highband portion of a speech signal generally cannot be predicted accurately from the spectral envelope of the narrowband portion.

One particular example of wideband speech encoder A100 is configured to encode wideband speech signal S10 at a rate of about 8.55 kbps (kilobits per second), with about 7.55 kbps being used for narrowband filter parameters S40 and encoded narrowband excitation signal S50, and about 1 kbps being used for highband coding parameters (e.g., filter parameters and/or gain parameters) S60.

Figure 10B:
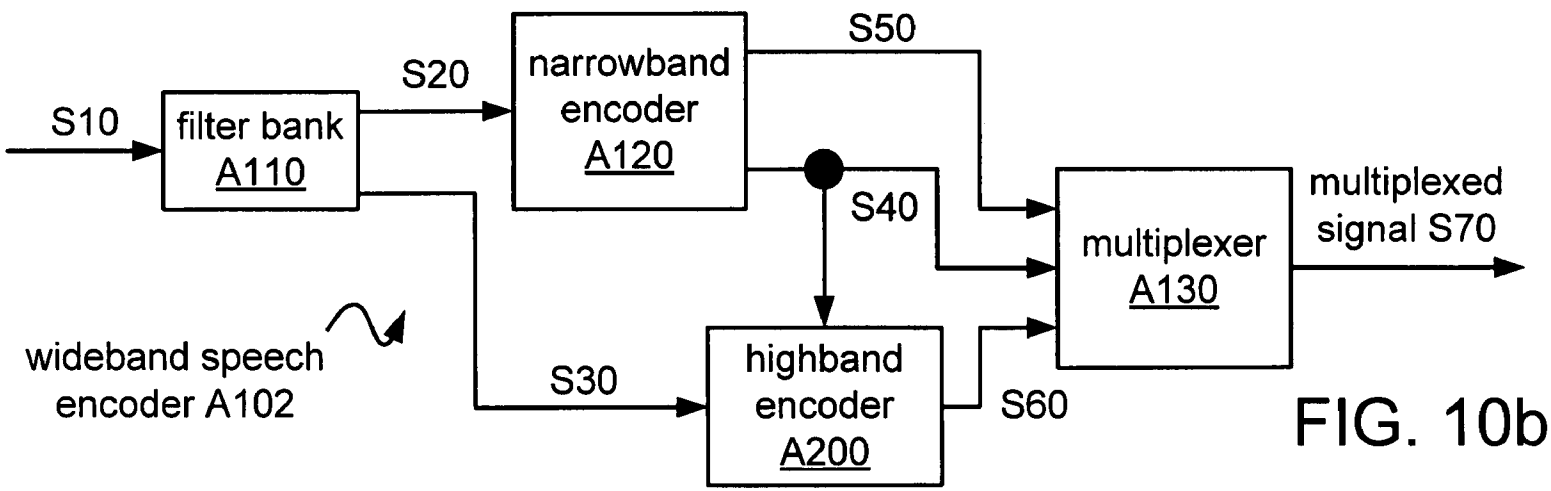
FIG. 10*b* is a block diagram of an implementation A102 of wideband speech encoder A100.
Figure 11B:
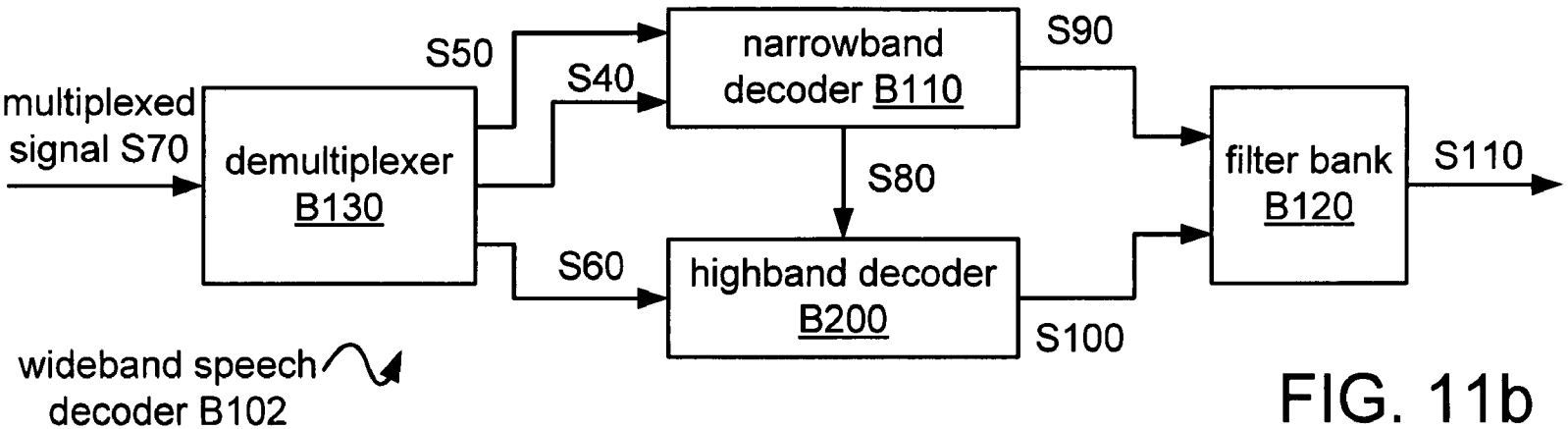
FIG. 11*b* is an example of a wideband speech decoder B102 corresponding to wideband speech encoder A102.

It may be desired to combine the encoded lowband and highband signals into a single bitstream. For example, it may be desired to multiplex the encoded signals together for transmission (e.g., over a wired, optical, or wireless transmission channel), or for storage, as an encoded wideband speech signal. FIG. 10*b* shows a block diagram of wideband speech encoder A102 that includes a multiplexer A130 configured to combine narrowband filter parameters S40, an encoded narrowband excitation signal S50, and highband coding parameters S60 into a multiplexed signal S70. FIG. 11*b* shows a block diagram of a corresponding implementation B102 of wideband speech decoder B100. Decoder B102 includes a demultiplexer B130 configured to demultiplex multiplexed signal S70 to obtain narrowband filter parameters S40, encoded narrowband excitation signal S50, and highband coding parameters S60.

It may be desirable for multiplexer A130 to be configured to embed the encoded lowband signal (including narrowband filter parameters S40 and encoded narrowband excitation signal S50) as a separable substream of multiplexed signal S70, such that the encoded lowband signal may be recovered and decoded independently of another portion of multiplexed signal S70 such as a highband and/or very-low-band signal. For example, multiplexed signal S70 may be arranged such that the encoded lowband signal may be recovered by stripping away the highband coding parameters S60. One potential advantage of such a feature is to avoid the need for transcoding the encoded wideband signal before passing it to a system that supports decoding of the lowband signal but does not support decoding of the highband portion.

An apparatus including a noise-shaping quantizer and/or a lowband, highband, and/or wideband speech encoder as described herein may also include circuitry configured to transmit the encoded signal into a transmission channel such as a wired, optical, or wireless channel. Such an apparatus may also be configured to perform one or more channel encoding operations on the signal, such as error correction encoding (e.g., rate-compatible convolutional encoding) and/or error detection encoding (e.g., cyclic redundancy encoding), and/or one or more layers of network protocol encoding (e.g., Ethernet, TCP/IP, cdma2000).

It may be desirable to implement a lowband speech encoder A120 as an analysis-by-synthesis speech encoder. Codebook excitation linear prediction (CELP) coding is one popular family of analysis-by-synthesis coding, and implementations of such coders may perform waveform encoding of the residual, including such operations as selection of entries from fixed and adaptive codebooks, error minimization operations, and/or perceptual weighting operations. Other implementations of analysis-by-synthesis coding include mixed excitation linear prediction (MELP), algebraic CELP (ACELP), relaxation CELP (RCELP), regular pulse excitation (RPE), multi-pulse CELP (MPE), and vector-sum excited linear prediction (VSELP) coding. Related coding methods include multi-band excitation (MBE) and prototype waveform interpolation (PWI) coding. Examples of standardized analysis-by-synthesis speech codecs include the ETSI (European Telecommunications Standards Institute)-GSM full rate codec (GSM 06.10), which uses residual excited linear prediction (RELP); the GSM enhanced full rate codec (ETSI-GSM 06.60); the ITU (International Telecommunication Union) standard 11.8 kb/s G.729 Annex E coder; the IS (Interim Standard)-641 codecs for IS-136 (a time-division multiple access scheme); the GSM adaptive multirate (GSM-AMR) codecs; and the 4GV™ (Fourth-Generation Vocoder™) codec (QUALCOMM Incorporated, San Diego, Calif.). Existing implementations of RCELP coders include the Enhanced Variable Rate Codec (EVRC), as described in Telecommunications Industry Association (TIA) IS-127, and the Third Generation Partnership Project 2 (3GPP2) Selectable Mode Vocoder (SMV). The various lowband, highband, and wideband encoders described herein may be implemented according to any of these technologies, or any other speech coding technology (whether known or to be developed) that represents a speech signal as (A) a set of parameters that describe a filter and (B) a quantized representation of a residual signal that provides at least part of an excitation used to drive the described filter to reproduce the speech signal.

As mentioned above, embodiments as described herein include implementations that may be used to perform embedded coding, supporting compatibility with narrowband systems and avoiding a need for transcoding. Support for highband coding may also serve to differentiate on a cost basis between chips, chipsets, devices, and/or networks having wideband support with backward compatibility, and those having narrowband support only. Support for highband coding as described herein may also be used in conjunction with a technique for supporting lowband coding, and a system, method, or apparatus according to such an embodiment may support coding of frequency components from, for example, about 50 or 100 Hz up to about 7 or 8 kHz.

As mentioned above, adding highband support to a speech coder may improve intelligibility, especially regarding differentiation of fricatives. Although such differentiation may usually be derived by a human listener from the particular context, highband support may serve as an enabling feature in speech recognition and other machine interpretation applications, such as systems for automated voice menu navigation and/or automatic call processing.

An apparatus according to an embodiment may be embedded into a portable device for wireless communications, such as a cellular telephone or personal digital assistant (PDA). Alternatively, such an apparatus may be included in another communications device such as a VoIP handset, a personal computer configured to support VoIP communications, or a network device configured to route telephonic or VoIP communications. For example, an apparatus according to an embodiment may be implemented in a chip or chipset for a communications device. Depending upon the particular application, such a device may also include such features as analog-to-digital and/or digital-to-analog conversion of a speech signal, circuitry for performing amplification and/or other signal processing operations on a speech signal, and/or radio-frequency circuitry for transmission and/or reception of the coded speech signal.

It is explicitly contemplated and disclosed that embodiments may include and/or be used with any one or more of the other features disclosed in the U.S. Provisional Pat. App. No. 60/667,901, now U.S. Pub. No. 2007/0088542. Such features include shifting of highband signal S30 and/or highband excitation signal S120 according to a regularization or other shift of narrowband excitation signal S80 or narrowband residual signal S50. Such features include adaptive smoothing of LSFs, which may be performed prior to a quantization as described herein. Such features also include fixed or adaptive smoothing of a gain envelope, and adaptive attenuation of a gain envelope.

The foregoing presentation of the described embodiments is provided to enable any person skilled in the art to make or use the present invention. Various modifications to these embodiments are possible, and the generic principles presented herein may be applied to other embodiments as well. For example, an embodiment may be implemented in part or in whole as a hard-wired circuit, as a circuit configuration fabricated into an application-specific integrated circuit, or as a firmware program loaded into non-volatile storage or a software program loaded from or into a data storage medium (e.g., a non-transitory computer-readable medium) as machine-readable code, such code being instructions executable by an array of logic elements such as a microprocessor or other digital signal processing unit. The non-transitory computer-readable medium may be an array of storage elements such as semiconductor memory (which may include without limitation dynamic or static RAM (random-access memory), ROM (read-only memory), and/or flash RAM), or ferroelectric, magnetoresistive, ovonic, polymeric, or phase-change memory; or a disk medium such as a magnetic or optical disk. The term "software" should be understood to include source code, assembly language code, machine code, binary code, firmware, macrocode, microcode, any one or more sets or sequences of instructions executable by an array of logic elements, and any combination of such examples.

The various elements of implementations of a noise-shaping quantizer; highband speech encoder A200; wideband speech encoder A100 and A102; and arrangements including one or more such apparatus, may be implemented as electronic and/or optical devices residing, for example, on the same chip or among two or more chips in a chipset, although other arrangements without such limitation are also contemplated. One or more elements of such an apparatus may be implemented in whole or in part as one or more sets of instructions arranged to execute on one or more fixed or programmable arrays of logic elements (e.g., transistors, gates) such as microprocessors, embedded processors, IP cores, digital signal processors, FPGAs (field-programmable gate arrays), ASSPs (application-specific standard products), and ASICs (application-specific integrated circuits). It is also possible for one or more such elements to have structure in common (e.g., a processor used to execute portions of code corresponding to different elements at different times, a set of instructions executed to perform tasks corresponding to different elements at different times, or an arrangement of electronic and/or optical devices performing operations for different elements at different times). Moreover, it is possible for one or more such elements to be used to perform tasks or execute other sets of instructions that are not directly related to an operation of the apparatus, such as a task relating to another operation of a device or system in which the apparatus is embedded.

Embodiments also include additional methods of speech processing and speech encoding, as are expressly disclosed herein, e.g., by descriptions of structural embodiments configured to perform such methods, as well as methods of highband burst suppression. Each of these methods may also be tangibly embodied (for example, in one or more data storage media as listed above) as one or more sets of instructions readable and/or executable by a machine including an array of logic elements (e.g., a processor, microprocessor, microcontroller, or other finite state machine). Thus, the present invention is not intended to be limited to the embodiments shown above but rather is to be accorded the widest scope consistent with the principles and novel features disclosed in any fashion herein.

What is claimed is:

1. A method for signal processing, said method comprising performing each of the following acts within a device that is configured to process speech signals:

encoding a first frame and a second frame of a speech signal to produce corresponding first and second vectors, wherein the first vector describes a spectral envelope of the speech signal during the first frame and the second vector describes a spectral envelope of the speech signal during the second frame;

generating a first quantized vector, said generating including quantizing a third vector that is based on the first vector;

dequantizing the first quantized vector to produce a first dequantized vector;

calculating a quantization error of the first quantized vector, wherein the quantization error indicates a difference between the first dequantized vector and one among the first and third vectors;

calculating a fourth vector, said calculating of the fourth vector including adding a scaled version of the quantization error to the second vector; and quantizing the fourth vector, wherein the third vector describes a spectral envelope of the speech signal during the first frame and the fourth vector describes a spectral envelope of the speech signal during the second frame.

2. The method according to claim 1, wherein each among the first and second vectors includes a representation of a plurality of linear prediction filter coefficients.

3. The method according to claim 1, wherein each among the first and second vectors includes a plurality of line spectral frequencies.

4. A non-transitory data storage medium having machine-executable instructions describing the method according to claim 1.

5. The method according to claim 1, wherein the second frame immediately follows the first frame in the speech signal.

6. The method according to claim 1, wherein each among the first and second vectors represents an adaptively smoothed spectral envelope.

7. The method according to claim 1, wherein said method comprises:

dequantizing the fourth vector; and calculating an excitation signal based on the dequantized fourth vector.

8. The method according to claim 1, wherein said speech signal is a narrowband speech signal, and wherein said method comprises filtering a wideband speech signal to obtain the narrowband speech signal and a highband speech signal.

9. The method according to claim 1, wherein said speech signal is a highband speech signal, and wherein said method comprises filtering a wideband speech signal to obtain a narrowband speech signal and the highband speech signal.

10. The method according to claim 1, wherein said speech signal is a narrowband speech signal, and wherein said method comprises:

filtering a wideband speech signal to obtain the narrowband speech signal and a highband speech signal;

dequantizing the fourth vector;

based on the dequantized fourth vector, calculating an excitation signal for the narrowband speech signal; and based on the excitation signal for the narrowband speech signal, deriving an excitation signal for the highband speech signal.

11. The method according to claim 1, wherein said quantizing the fourth vector comprises performing a split vector quantization of the fourth vector.

12. The method according to claim 1, wherein said calculating a quantization error includes calculating a difference between the first dequantized vector and the first vector.

13. The method according to claim 1, wherein said calculating a quantization error includes calculating a difference between the first dequantized vector and the third vector.

14. The method according to claim 1, said method including calculating the scaled version of the quantization error, said calculating comprising multiplying the quantization error by a scale factor, wherein the scale factor is based on a distance between the first vector and the second vector.

15. The method according to claim 1, wherein the third vector is a smoothed version of the first vector.

16. A non-transitory computer-readable medium comprising instructions which when executed by a processor cause the processor to:

encode a first frame and a second frame of a speech signal to produce corresponding first and second vectors, wherein the first vector describes a spectral envelope of the speech signal during the first frame and the second vector describes a spectral envelope of the speech signal during the second frame;

generate a first quantized vector, said generating including quantizing a third vector that is based on the first vector;

dequantize the first quantized vector to produce a first dequantized vector;

calculate a quantization error of the first quantized vector, wherein the quantization error indicates a difference between the first dequantized vector and one among the first and third vectors;

calculate a fourth vector, said calculating of the fourth vector including adding a scaled version of the quantization error to the second vector; and quantize the fourth vector, wherein the third vector describes a spectral envelope of the speech signal during the first frame and the fourth vector describes a spectral envelope of the speech signal during the second frame.

17. The computer-readable medium according to claim 16, wherein the instructions that cause the processor to calculate a quantization error include instructions to calculate a difference between the first quantized vector and the third vector.

18. The computer-readable medium according to claim 16, the instructions that cause the processor to calculate the scaled quantization error, further comprise instructions to:

multiply the quantization error by a scale factor, wherein the scale factor is based on a distance between at least a portion of the first vector and a corresponding portion of the second vector.

19. The computer-readable medium according to claim 18, wherein each among the first and second vectors includes a plurality of line spectral frequencies.

20. The computer-readable medium according to claim 16, wherein each among the first and second vectors includes a representation of a plurality of linear prediction filter coefficients.

21. The computer-readable medium according to claim 16, wherein the instructions that cause the processor to calculate a quantization error include instructions to calculate a difference between the first quantized vector and the first vector.

22. An apparatus comprising:

a speech encoder configured to encode a first frame and a second frame of a speech signal to produce corresponding first and second vectors, wherein the first vector describes a spectral envelope of the speech signal during the first frame and the second vector describes a spectral envelope of the speech signal during the second frame;

a quantizer configured to quantize a third vector that is based on the first vector to generate a first quantized vector;

an inverse quantizer configured to dequantize the first quantized vector to produce a first dequantized vector;

a first adder configured to calculate a quantization error of the first quantized vector, wherein the quantization error indicates a difference between the first dequantized vector and one among the first and third vectors; and a second adder configured to add a scaled version of the quantization error to the second vector to calculate a fourth vector, wherein said quantizer is configured to quantize the fourth vector, and wherein the third vector describes a spectral envelope of the speech signal during the first frame and the fourth vector describes a spectral envelope of the speech signal during the second frame.

23. The apparatus according to claim 22, wherein said first adder is configured to calculate the quantization error based on a difference between the first quantized vector and the third vector.

24. The apparatus according to claim 22, said apparatus including a multiplier configured to calculating the scaled quantization error based on a product of the quantization error and a scale factor, wherein said apparatus includes logic configured to calculate the scale factor based on a distance between at least a portion of the first vector and a corresponding portion of the second vector.

25. The apparatus according to claim 24, wherein each among the first and second vectors includes a plurality of line spectral frequencies.

26. The apparatus according to claim 22, wherein each among the first and second vectors includes a representation of a plurality of linear prediction filter coefficients.

27. The apparatus according to claim 22, wherein each among the first and second vectors includes a plurality of line spectral frequencies.

28. The apparatus according to claim 22, said apparatus comprising a device for wireless communications.

29. The apparatus according to claim 22, said apparatus comprising a device configured to transmit a plurality of packets compliant with a version of the Internet Protocol, wherein the plurality of packets describes the first quantized vector.

30. The apparatus according to claim 22, wherein the second frame immediately follows the first frame in the speech signal.

31. The apparatus according to claim 22, wherein each among the first and second vectors represents an adaptively smoothed spectral envelope.

32. The apparatus according to claim 22, wherein said apparatus comprises:

an inverse quantizer configured to dequantize the fourth vector; and a whitening filter configured to calculate an excitation signal based on the dequantized fourth vector.

33. The apparatus according to claim 22, wherein said speech signal is a narrowband speech signal, and wherein said apparatus comprises a filter bank configured to filter a wideband speech signal to obtain the narrowband speech signal and a highband speech signal.

34. The apparatus according to claim 22, wherein said speech signal is a highband speech signal, and wherein said apparatus comprises a filter bank configured to filter a wideband speech signal to obtain a narrowband speech signal and the highband speech signal.

35. The apparatus according to claim 22, wherein said speech signal is a narrowband speech signal, and wherein said apparatus comprises:

a filter bank configured to filter a wideband speech signal to obtain the narrowband speech signal and a highband speech signal;

an inverse quantizer configured to dequantize the fourth vector;

a whitening filter configured to calculate an excitation signal for the narrowband speech signal based on the dequantized fourth vector; and a highband encoder configured to derive an excitation signal for the highband speech signal based on the excitation signal for the narrowband speech signal.

36. The apparatus according to claim 22, wherein said quantizer is configured to quantize the fourth vector by performing a split vector quantization of the fourth vector.

37. The apparatus according to claim 22, wherein said first adder is configured to calculate the quantization error based on a difference between the first quantized vector and the third vector.

38. The apparatus according to claim 22, wherein the third vector is a smoothed version of the first vector.

39. An apparatus comprising:

means for encoding a first frame and a second frame of a speech signal to produce corresponding first and second vectors, wherein the first vector describes a spectral envelope of the speech signal during the first frame and the second vector describes a spectral envelope of the speech signal during the second frame;

means for generating a first quantized vector, said generating including quantizing a third vector that is based on the first vector;

means for dequantizing the first quantized vector to produce a first dequantized vector;

means for calculating a quantization error of the first quantized vector, wherein the quantization error indicates a difference between the first dequantized vector and one among the first and third vectors;

means for calculating a fourth vector, said calculating of the fourth vector including adding a scaled version of the quantization error to the second vector; and means for quantizing the fourth vector, wherein the third vector describes a spectral envelope of the speech signal during the first frame and the fourth vector describes a spectral envelope of the speech signal during the second frame.

40. The apparatus according to claim 39, wherein said means for calculating a quantization error is configured to calculate the quantization error based on a difference between the first quantized vector and the third vector.

41. The apparatus according to claim 39, said apparatus including means for calculating the scaled quantization error, said calculating comprising multiplying the quantization error by a scale factor, wherein said apparatus comprises logic configured to calculate the scale factor based on a distance between at least a portion of the first vector and a corresponding portion of the second vector.

42. The apparatus according to claim 41, wherein each among the first and second vectors includes a plurality of line spectral frequencies.

43. The apparatus according to claim 39, said apparatus comprising a device for wireless communications.

44. The apparatus according to claim 39, wherein the second frame immediately follows the first frame in the speech signal.

45. The apparatus according to claim 39, wherein each among the first and second vectors represents an adaptively smoothed spectral envelope.

46. The apparatus according to claim 39, wherein said apparatus comprises:

means for dequantizing the fourth vector; and means for calculating an excitation signal based on the dequantized fourth vector.

47. The apparatus according to claim 39, wherein said speech signal is a narrowband speech signal, and wherein said apparatus comprises means for filtering a wideband speech signal to obtain the narrowband speech signal and a highband speech signal.

48. The apparatus according to claim 39, wherein said speech signal is a highband speech signal, and wherein said apparatus comprises means for filtering a wideband speech signal to obtain a narrowband speech signal and the highband speech signal.

49. The apparatus according to claim 39, wherein said speech signal is a narrowband speech signal, and wherein said apparatus comprises:

means for filtering a wideband speech signal to obtain the narrowband speech signal and a highband speech signal;

means for dequantizing the fourth vector;

means for calculating an excitation signal for the narrowband speech signal based on the dequantized fourth vector; and means for deriving an excitation signal for the highband speech signal based on the excitation signal for the narrowband speech signal.

50. The apparatus according to claim 39, wherein said means for generating a first quantized vector is configured to quantize the fourth vector by performing a split vector quantization of the fourth vector.

51. The apparatus according to claim 39, wherein said means for calculating a quantization error is configured to calculate the quantization error based on a difference between the first quantized vector and the third vector.

* * * * *